US008247990B1

(12) United States Patent
Gordin et al.

(10) Patent No.: US 8,247,990 B1
(45) Date of Patent: Aug. 21, 2012

(54) APPARATUS, METHOD, AND SYSTEM FOR IMPROVED SWITCHING METHODS FOR POWER ADJUSTMENTS IN LIGHT SOURCES

(75) Inventors: Myron Gordin, Oskaloosa, IA (US); Timothy J. Boyle, Oskaloosa, IA (US); Gregory N. Kubbe, Ottumwa, IA (US); Gabriel P. Gromotka, Pella, IA (US)

(73) Assignee: Musco Corporation, Oskaloosa, IA (US)

( * ) Notice: Subject to any disclaimer, the term of this patent is extended or adjusted under 35 U.S.C. 154(b) by 474 days.

(21) Appl. No.: 12/534,504

(22) Filed: Aug. 3, 2009

Related U.S. Application Data

(60) Provisional application No. 61/201,066, filed on Dec. 5, 2008.

(51) Int. Cl.
*H05B 37/02* (2006.01)

(52) U.S. Cl. ..... 315/291; 315/144; 315/297; 315/227 R

(58) Field of Classification Search ..... 315/141–146, 315/227 R, 278, 291, 297, 299, 239
See application file for complete search history.

(56) References Cited

U.S. PATENT DOCUMENTS

| | | | |
|---|---|---|---|
| 4,005,336 | A | 1/1977 | Casella |
| 4,009,387 | A | 2/1977 | Nuver |
| 4,189,664 | A | 2/1980 | Hirschfeld |
| 4,189,964 | A | 2/1980 | Gray |
| 4,292,570 | A | 9/1981 | Engel |
| 4,384,239 | A | 5/1983 | Davenport |
| 4,434,388 | A | 2/1984 | Carver et al. |
| 4,442,382 | A | 4/1984 | Fleck |
| 4,451,763 | A | 5/1984 | Sodini |
| 4,475,065 | A | 10/1984 | Bhalla et al. |
| 4,501,994 | A | 2/1985 | Spreadbury |
| 4,623,860 | A | 11/1986 | Baker et al. |
| 4,725,934 | A | 2/1988 | Gordin |

(Continued)

FOREIGN PATENT DOCUMENTS

AU 2004237249 B2 11/2004

(Continued)

OTHER PUBLICATIONS

"Control Link—Flexible control and solid management of your facility, saves operating costs and improves service", Musco Corporation, Oskaloosa, Iosa, 2005, 9 page.

(Continued)

*Primary Examiner* — Don Le
(74) *Attorney, Agent, or Firm* — McKee, Voorhees & Sease, P.L.C.

(57) ABSTRACT

An apparatus, method, and system for switch control of power to light sources, particularly high power consumption light sources that may experience lumen depreciation, such that the power level to a light source may be increased or decreased as desired. Methods of switching utilizing robust mechanical components such as solenoids, coupled with accurate and rapid electronic control components such as microprocessors, may be combined with a combinational approach to capacitance changes to comprise a flexible method of power control to a light source or plurality of light sources. Power to a light source may be adjusted such that the amount of energy consumed and the quantity of light output may be adjusted, compensation may be made for lumen depreciation and other losses that occur during operational life of the light source, to maintain constant or near-constant light output, or otherwise.

38 Claims, 25 Drawing Sheets

U.S. PATENT DOCUMENTS

| | | | | |
|---|---|---|---|---|
| 4,816,974 | A | 3/1989 | Gordin | |
| 4,891,562 | A | 1/1990 | Nuckolls et al. | |
| 4,924,109 | A | 5/1990 | Weber | |
| 4,931,701 | A | 6/1990 | Carl | |
| 4,947,303 | A | 8/1990 | Gordin et al. | |
| 4,994,718 | A | 2/1991 | Gordin | |
| 5,075,828 | A | 12/1991 | Gordin et al. | |
| 5,103,143 | A | 4/1992 | Daub | |
| 5,134,557 | A | 7/1992 | Gordin et al. | |
| 5,161,883 | A | 11/1992 | Gordin et al. | |
| 5,229,681 | A | 7/1993 | Gordin et al. | |
| 5,272,418 | A | 12/1993 | Howe et al. | |
| 5,391,966 | A | 2/1995 | Garrison | |
| 5,434,763 | A | 7/1995 | Hege et al. | |
| 5,442,177 | A | 8/1995 | Boulos et al. | |
| 5,442,261 | A | 8/1995 | Bank et al. | |
| 5,463,285 | A | 10/1995 | El-Hamamsy | |
| 5,469,027 | A | 11/1995 | Uchihashi et al. | |
| 5,475,360 | A | 12/1995 | Guidette et al. | |
| 5,519,286 | A | 5/1996 | Rodrigues et al. | |
| 5,751,116 | A | 5/1998 | Thomas et al. | |
| 5,856,326 | A | 1/1999 | Anthony et al. | |
| 5,856,721 | A | 1/1999 | Gordin et al. | |
| 5,883,557 | A | 3/1999 | Pawlak et al. | |
| 5,962,988 | A | 10/1999 | Nuckolls et al. | |
| 6,031,340 | A | 2/2000 | Brosius | |
| 6,075,326 | A | 6/2000 | Nostwick | |
| 6,114,816 | A | 9/2000 | Nuckolls et al. | |
| 6,150,772 | A | 11/2000 | Crane | |
| 6,172,469 | B1 | 1/2001 | Kern | |
| 6,175,195 | B1 | 1/2001 | Janczak et al. | |
| 6,188,161 | B1 | 2/2001 | Yoshida et al. | |
| 6,188,181 | B1 | 2/2001 | Sinha et al. | |
| 6,191,568 | B1 | 2/2001 | Poletti | |
| 6,194,847 | B1 | 2/2001 | Hollaway | |
| 6,207,943 | B1 | 3/2001 | Smelker | |
| 6,215,254 | B1 | 4/2001 | Honda et al. | |
| 6,225,760 | B1 | 5/2001 | Moan | |
| 6,316,923 | B1 | 11/2001 | Poletti | |
| 6,320,323 | B1 | 11/2001 | Buell et al. | |
| 6,340,261 | B1 | 1/2002 | Furukawa | |
| 6,373,201 | B2 | 4/2002 | Morgan et al. | |
| 6,376,996 | B1 | 4/2002 | Olson | |
| 6,400,103 | B1 | 6/2002 | Adamson | |
| 6,456,960 | B1 | 9/2002 | Williams et al. | |
| 6,501,231 | B1 | 12/2002 | Hyland et al. | |
| 6,515,430 | B2 | 2/2003 | Kayser | |
| 6,545,429 | B1 | 4/2003 | Flory, IV | |
| 6,545,433 | B2 | 4/2003 | Beij et al. | |
| 6,577,075 | B2 | 6/2003 | Romano et al. | |
| 6,583,574 | B2 | 6/2003 | Ann et al. | |
| 6,681,110 | B1 | 1/2004 | Crookham et al. | |
| 6,713,973 | B2 | 3/2004 | Erhardt | |
| 6,774,768 | B2 * | 8/2004 | Flory, IV | 340/309.16 |
| 6,798,153 | B2 | 9/2004 | Mattas et al. | |
| 6,864,645 | B2 | 3/2005 | Sun et al. | |
| 7,038,390 | B2 * | 5/2006 | Swami et al. | 315/112 |
| 7,176,635 | B2 | 2/2007 | Gordin et al. | |
| 7,176,867 | B2 | 2/2007 | Lee | |
| 7,385,360 | B2 | 6/2008 | Dluzniak | |
| 7,429,828 | B2 | 9/2008 | Cleland et al. | |
| 7,432,670 | B2 | 10/2008 | Yamashita et al. | |
| 7,589,480 | B2 | 9/2009 | Greenwood et al. | |
| 7,675,251 | B2 | 3/2010 | Gordin et al. | |
| 7,734,356 | B2 * | 6/2010 | Cleland et al. | 700/12 |
| 7,834,555 | B2 | 11/2010 | Cleland et al. | |
| 7,956,551 | B1 | 6/2011 | Gordin | |
| 7,956,556 | B1 | 6/2011 | Gordin et al. | |
| 7,982,404 | B2 * | 7/2011 | Gordin | 315/144 |
| 2002/0089293 | A1 | 7/2002 | Romano et al. | |
| 2002/0185980 | A1 | 12/2002 | Beij et al. | |
| 2003/0025463 | A1 | 2/2003 | Mattas et al. | |
| 2003/0090215 | A1 | 5/2003 | Beasley | |
| 2005/0184681 | A1 | 8/2005 | Gordin et al. | |
| 2006/0071610 | A1 | 4/2006 | Dluzniak | |
| 2007/0001617 | A1 | 1/2007 | Pogodayev et al. | |
| 2007/0040513 | A1 | 2/2007 | Cleland et al. | |
| 2007/0043540 | A1 | 2/2007 | Cleland et al. | |
| 2007/0043541 | A1 | 2/2007 | Cleland et al. | |
| 2007/0070571 | A1 | 3/2007 | Gordin et al. | |
| 2008/0150451 | A1 | 6/2008 | Gordin | |

FOREIGN PATENT DOCUMENTS

| | | | |
|---|---|---|---|
| CA | 1288803 | | 9/1991 |
| DE | 19540326 | A1 | 4/1997 |
| DE | 19912517 | A1 | 9/2000 |
| EP | 0439358 | A2 | 7/1991 |
| EP | 0536877 | A1 | 4/1993 |
| EP | 0536877 | B1 | 4/1993 |
| EP | 0669788 | A1 | 8/1995 |
| JP | 6163163 | A | 6/1994 |
| JP | 9180886 | A | 7/1997 |
| TW | 148059 | | 12/1990 |
| WO | 2005036877 | | 4/2005 |
| WO | 2005084086 | A1 | 9/2005 |
| WO | 2008037118 | A1 | 4/2008 |

OTHER PUBLICATIONS

"Escapement", Wikipedia printout, [retrieved on May 26, 2009 from the Internet: http://en.wikipedia.org/wiki/ Escapement, 9 pages.

"Latching Solenoid Valve Details—Marotta Latching Solenoid Valves", [retrieved on May 27, 2009 from the Internet: http://www.marotta.com/DataSheets/solenoid_latch_valve_details.htm], 1 page.

LE4S Series—LCD Backlit, Programmable, Multi-Function, Digital Timer/Controller, Youngstown, Ohio, 11 pages.

"LEDEX—Solenoids—Magnetically Latching Solenoids", [retrieved on May 27, 2009 from the Internet: http://w2s.ledex.com/ledx/ds/lx000/1x0002e.lass?pcode=L217], 1 page.

"LPC2131/2132/2134/2136/2138—Single-chip 16/32-bit microcontrollers; 32/64/128/256/512 kB ISP/IAP Flash with 10-bit ADC and DAC", Preliminary Data Sheet, Koninklijke Philips Electronics N.V. 2005, 42 pages.

"Multi-Watt allows two light levels, reduces energy costs", Multi-Watt, Musco Corporation, Oskaloosa, Iowa, 1992, 2002, 4 pages.

"Technical Information—Lamps", Venture Lighting International, www.venturelighting.com, 1 page.

"Venture's Technical Information Ballasts", Venture Lighting, [retrieved from the Internet on Dec. 18, 2006 from http://www.venturelighting.com/TechCenter/BallastTechIntro.html], 2006, 6 pages.

English Abstract of EP 0669788A1, published on Aug. 30, 1995, 1 page.

English Abstract of DE 19540326, published on Apr. 30, 1997, 1 page.

English Translation of DE 19540326 A1, published on Apr. 30, 1997, 13 pages.

English Abstract of DE 19912517, published on Sep. 21, 2000, 1 page.

English Abstract of JP 6163163, published on Jun. 10, 1994, 1 page.

English Abstract of JP 9180886, published on Jul. 11, 1997, 1 page.

English Translation of JP 9180886 A, published on Jul. 11, 1997, 8 page.

* cited by examiner

LATCHED

UNLATCHED

APPARATUS, METHOD, AND SYSTEM FOR IMPROVED SWITCHING METHODS FOR POWER ADJUSTMENTS IN LIGHT SOURCES

CROSS-REFERENCE TO RELATED APPLICATIONS

This application claims priority under 35 U.S.C. §119 to provisional U.S. application Ser. No. 61/201,066, filed Dec. 5, 2008, hereby incorporated by reference in its entirety.

I. BACKGROUND OF INVENTION

A. Field of Invention

The present invention relates to switch control of power to light sources, particularly high power consumption light sources, such that the power level to a light source may be increased or decreased as desired. Improved methods of switch control may be applicable to a variety of components within an electrical system, and may be combined with combinational capacitance to comprise a flexible method of power control to a light source. Power to a light source may be adjusted such that the amount of energy consumed and the quantity of light output may be adjusted, compensation may be made for lumen depreciation and other losses that occur during operational life of the light source, constant or near-constant light output may be maintained, or otherwise.

B. Problems in the Art

Electrical systems operating light sources may benefit from power control for a variety of reasons including, but not limited to, energy conservation and the preservation of the quantity of light output.

High power light sources, such as those used in sports lighting applications, may readily consume considerable amounts of energy per hour; this is due in part to the plurality of light sources typically utilized in a given application. Therefore, improvements over the current state of the art in terms of energy conservation may produce significant benefits. One method of addressing energy conservation is to operate a light source at reduced power levels during off-peak operating conditions (e.g. for a typical sports lighting application, operating at a high power setting during tournament play versus operating at a low power setting during practice). Electrical systems with preset high/low power settings are well known in the art; methods of addressing energy conservation by operating at reduced power levels for said electrical systems may be found in U.S. Pat. No. 4,994,718 and commercially available from Musco Lighting, LLC, Oskaloosa, Iowa, USA under the trade name MULTI-WATT™.

Preservation of the quantity of light output is a concern for many light sources, particularly those which may experience lamp lumen depreciation (LLD), a condition in which the amount of light the source produces diminishes over its operating lifespan. One example of a light source that experiences LLD is a high intensity discharge (HID) lamp (e.g. model MH 1500W/HBU from Venture Lighting International, Solon, Ohio, U.S.A.); this type of lamp is typically used in wide area lighting applications such as sports lighting. FIG. 1 illustrates a generalized light output curve 2 for a light source that experiences LLD. As can be seen from FIG. 1, LLD tends to produce a significant decrease in light output (as evidenced by the hatched area) over the cumulative operating life of the light source. During the initial operation of the light source LLD is most severe, as is evidenced by the significant slope 6 of the curve 2 between T0 (0 hours of cumulative operating time) and T1 (200 hours of cumulative operating time). Beyond T1, LLD still produces a decrease in light, albeit at a diminished rate, as evidenced by the shallower slope 8 between T1 and T4 (3000 hours of cumulative operating time).

One method of addressing the diminishing quantity of light output due to LLD or otherwise is to incrementally increase power to the electrical system via capacitance increases over the course of the operating life of the light source. Assume, for example, a metal halide HID lamp operating at 1500 rated operating wattage (ROW) with typical LLD characteristics such as is demonstrated by curve 2 of FIG. 1. A user may incrementally increase power to the electrical system operating said light source at periodic intervals to maintain a constant or near-constant light output. It is of note that the terms "constant" and "near-constant" are used interchangeably in this text with respect to light output. Methods of increasing light output described herein may be made at any incremental value and at any number of increments; thus, while the methods may approach near-constant light output in terms of measurable quantities (e.g. lumens) over the cumulative operating time of a light source, such incremental changes may be made in such small increments over such a long range of values that to a user light output appears to be constant and, thus, does not depart from aspects of the invention described herein.

FIG. 2 illustrates how such periodic increases to operating wattage (see FIG. 3) result in an increase to relative light output (as evidenced by sawtooth line 10) which may prevent significant light loss (as evidenced by hatched area 112) that would otherwise occur (as evidenced by curve 2). To conserve energy and prevent overdriving said lamp later during its operating life as power increases are added to the electrical system, the initial operating wattage of the lamp may be started at a wattage below ROW. For the aforementioned example of a lamp operating at 1500 ROW, a starting wattage of 1050 watt may be utilized with incremental power increases made until the lamp's maximum operating life is met or the operating wattage of the lamp exceeds a maximum (as defined by the lamp manufacturer or otherwise). FIG. 3 illustrates how incremental increases to operating wattage (as evidenced by line 116) to approach ROW (as evidenced by hatched area 114) may produce constant or near-constant light output as illustrated in FIG. 2 (as evidenced by sawtooth line 10); potential savings from operating at wattages below ROW may generally be indicated by hatched area 114.

Electrical systems operating light sources that experience LLD are well known in the art; methods of addressing LLD, including one method of incremental power increases, may be found in U.S. Pat. No. 7,176,635 and commercially available from Musco Lighting, LLC, Oskaloosa, Iowa, USA under the trade name SMART LAMP®.

In the current state of the art, power adjustments to address energy conservation are generally completed by dimming or switching the circuits in the electrical system to achieve preset high/low levels. One way preservation of the quantity of light output in an electrical system may be completed is by adding capacitance at preset times and in preset quantities to a power regulating component (where power regulating component refers to a component operatively in connection between the main power and the light source which has the ability to change power provided to the light source) within the system. However, as will be discussed, there are limitations to using the aforementioned approaches to adjust power to a light source.

1. Energy Conservation—Dimming Circuits

Using sports lighting applications as an example, one common method to conserve energy is to operate a light source at a lower power level when less illumination is deemed acceptable by owners, participants, or by regulations set forth by lighting organizations; one such organization is the Illuminating Engineering Society of North America (IESNA). IESNA Publication No. RP-6-01 recommends minimum illumination levels based on the type of sport, skill level, and number of spectators; however, many sports lighting systems are used for multiple purposes that may require different levels of illumination (e.g. a soccer field that is used for practice but also for tournaments). Such electrical systems would need to be designed for the highest level of illumination required for tournament play based on the skill level of the players and the number of spectators, but would benefit from a lower illumination level available for practice. Operating at a lower power setting (and therefore a lower illumination level) during off-peak operating conditions results in energy conservation.

Generally, one way a sports lighting system operating a light source may switch from a high power setting to a lower power setting is by changing from a higher capacitance state to a lower capacitance state, commonly referred to as dimming the circuit. However, if a sports lighting system operates a plurality of light sources, dimming the circuits requires a plurality of capacitors for each light source. In addition, extra switching components are required to control the capacitors for each light source. For example, in sports or wide area lighting, due to the available space in a pole cabinet 50, FIG. 4A, or other enclosure housing the capacitors, as well as the cost associated with providing dimming for multiple light sources, most capacitor systems used for dimming are limited to a single high/low power setting.

2. Energy Conservation—Switching Circuits

A method to conserve energy in an electrical system operating a plurality of light sources, particularly a sports lighting system, is to utilize switching groups that operate a subset of the total number of light sources for lower illumination levels, and operate the total number of light sources for higher illumination levels. While this method addresses energy conservation, additional light sources are often required to ensure adequate beam distribution to attain illumination uniformity; again see IESNA Publication No. RP-6-01. Adding additional light sources to an electrical system, including the respective switching mechanisms to control the light sources, may add capital equipment cost, as well as cost from increased energy consumption. Additionally, the light sources in different switching groups may accumulate uneven operating hours if some groups are used more frequently than others; imbalance of operating hours may prevent illumination uniformity due to uneven LLD of the light sources.

3. Preservation of Light Output—Changing Capacitance

One approach to preserving the quantity of light output in an electrical system operating a light source is to make incremental increases to capacitance; see aforementioned U.S. Pat. No. 7,176,635. In one embodiment described in U.S. Pat. No. 7,176,635, an electric timer-motor rotates cams that, in turn, actuate switches, relays, or contactors to sequentially add capacitors to the lighting circuit at times determined by the physical configuration of the electric-timer motor and cams (for reference, see FIGS. 3, 10-13 in U.S. Pat. No. 7,176,635). Each cam is configured to rotate to a position that operates a switch at a preset time when additional capacitance is required to increase power to the light source. Generally, such increases in capacitance are utilized to compensate for LLD and to maintain constant light output. The preset timing is generally modeled after lumen depreciation curves for a given light source.

II. SUMMARY OF THE INVENTION

The effectiveness of adjusting power to light sources in an electrical system using currently available means of changing capacitance tends to be limited by the physical space required to provide a plurality of capacitors with traditional switching mechanisms, and the general inflexibility of capacitance changing systems. Improved methods of switch control, coupled with a combinational approach to changing capacitance, are envisioned for a variety of apparatuses. One typical application may be large area outdoor sports lighting systems and the power regulating components therein, but any electrical system or power regulating component of an electrical system operating a light source would likewise benefit.

It is of note that the aforementioned reference to power regulating component(s), and any mention of power regulating component(s) or power regulating circuits within this text, is intended to convey that an apparatus, operatively connected between the main power and the light, has the ability to change and thus regulate power provided to the light source. In these embodiments, the change in power level is effectuated by the selective actuation of switching mechanisms further described in the exemplary embodiments.

It is therefore a principle object, feature, advantage, or aspect of the present invention to improve over the state of the art.

It is a further object, feature, advantage, or aspect of the present invention to solve problems and deficiencies in the state of the art.

Further objects, features, advantages, or aspects of the present invention may include one or more of the following:

a. a flexible way to manage energy consumption,
b. a flexible way to control light output,
c. a flexible way to control light output to maintain constant or near-constant light and compensate for lumen depreciation or other light losses,
d. a flexible and accurate way to change the power level to light source(s), in terms of timing and magnitude,
e. a flexible, space and component efficient, robust, accurate, and economical system; and
f. a system that is conducive to remote control.

These and other objects, features, advantages, or aspects of the present invention will become more apparent with reference to the accompanying specification.

A method according to one aspect of the present invention comprises providing for each light source circuit a plurality of possible operating power levels and selectively switching in one or any combination of the plurality of power regulating components of the light source circuit to effectuate operating power levels.

An apparatus according to one aspect of the present invention comprises a plurality of switching mechanisms, each switching mechanism controlling a quantity of operating power to a light source or plurality of light sources; and a selectively controllable actuator for each switch; so that combinational power selections are available for the light source(s) by actuation of one or more switching mechanisms.

A method according to another aspect of the present invention comprises integration of improved switching methods and combinational capacitance in a wide area or sports lighting system to provide a flexible method of power control for the purposes of energy conservation, preserving the quantity of light output, maintaining constant light output, or otherwise. In one example, the flow of power to a light source may generally be characterized by the following:

1. Electrical power at a power distribution source (e.g. service distribution cabinet) is divided, for example, among breakers, and divided power (e.g. at a breaker) travels to a contactor module or analogous component in a housing (e.g., a control/contactor cabinet) via a power line.

a) Remote operation of the contactor modules may be enabled by a moderator module and antenna or analogous components.

2. Electrical power from the control/contactor cabinet travels to other components in closer proximity to the light source (e.g. in wide area lighting, a pole cabinet) via a power line.
3. Electrical power (e.g. at the pole cabinet or the like) travels through, for example, the other components (e.g. a disconnect switch, ballast, a capacitor bank), and powers the light source.
4. Multiple capacitors in the capacitor bank are utilized to attain various selectable power levels at the light source.
5. The above combination of components may be replicated to similarly supply selectable power levels to each of a plurality of light sources.
6. Selection of any one or combination of capacitors from the bank at any time may be through actuatable switching mechanisms.
7. Actuation of the switching mechanisms may be through a circuit or controller, or through manual operation.
8. This allows significant flexibility regarding power level adjustment on an application by application basis.

III. BRIEF DESCRIPTION OF THE DRAWINGS

From time-to-time in this description reference will be taken to the drawings which are identified by figure number and are summarized below.

FIG. 1 diagrammatically illustrates light output characteristics for a light source that experiences LLD.

FIG. 2 diagrammatically illustrates near-constant light output as a result of methods to compensate for the LLD characteristics illustrated in FIG. 1.

FIG. 3 diagrammatically illustrates incremental operating wattage increases to effectuate the near-constant light output illustrated in FIG. 2.

IV. DETAILED DESCRIPTION OF EXEMPLARY EMBODIMENT

A. Overview

Figure 1:
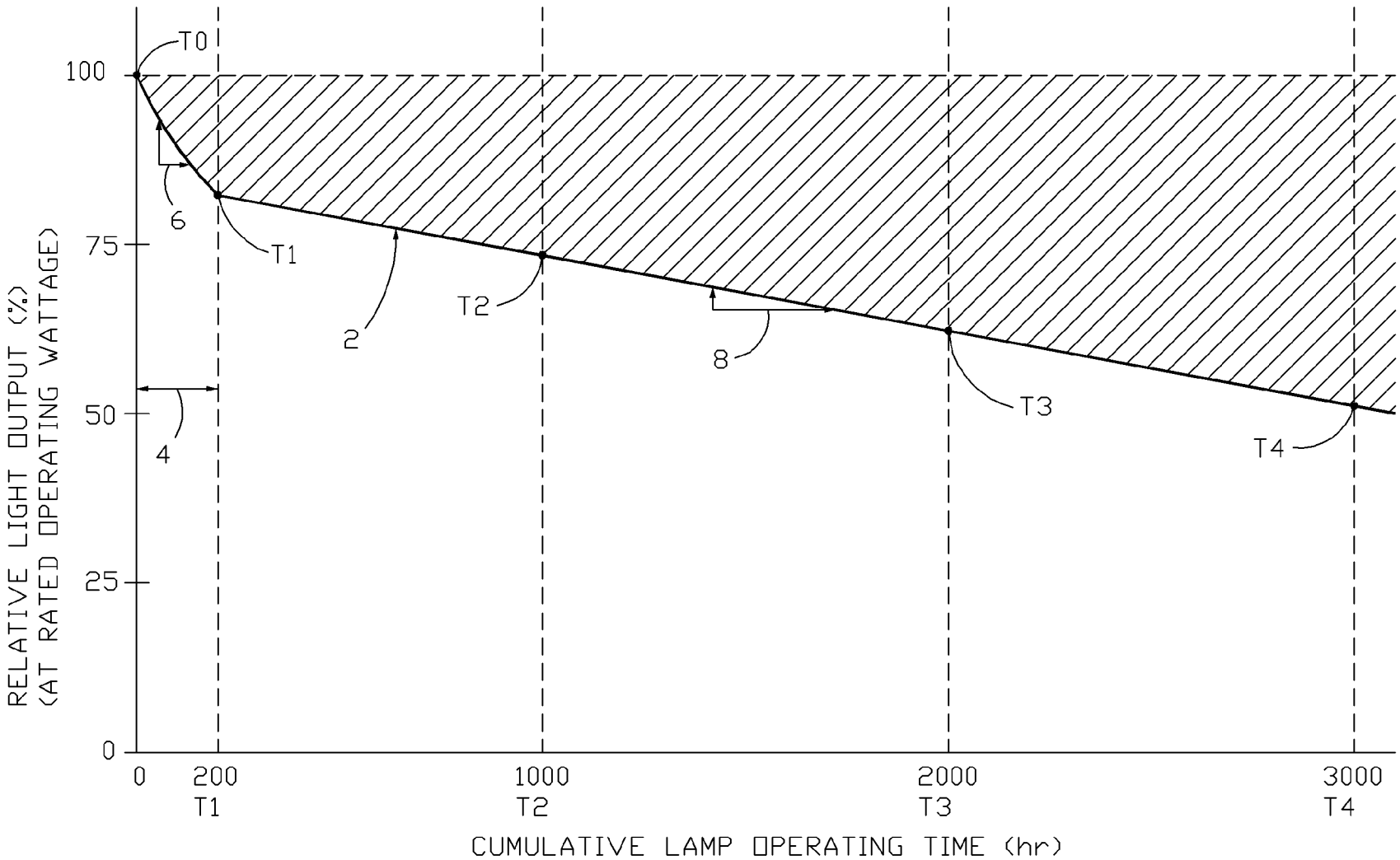

To further understanding of the present invention, several specific exemplary embodiments according to the present invention will be described in detail. Certain exemplary embodiments envision improved switching methods that may be combined with a power regulating component comprised of a parallel-connected bank of capacitors such that any combination of capacitors may be switched in and out of the light source circuit to achieve a desired power level. This combinational switching approach allows a relatively small group of capacitors to provide a large range of capacitance values for a single light source, or a plurality of light sources, from a single switch control. Alternate embodiments are also described.

Frequent mention will be made in this description to the drawings. Reference numbers will be used to indicate certain parts in the drawings. The same reference numbers will be used to indicate the same parts throughout the drawings (for example, 53 to denote the capacitor bank).

B. Background

There are a variety of methods utilized in the current state of the art to permit the power level to a light source to be increased or decreased as desired. Electrical systems such as that illustrated in FIGS. 4A and 4B may benefit from power control for a variety of reasons including, but not limited to, energy conservation, the preservation of the quantity of light output, and maintaining constant or near-constant light output. Envisioned are improved switching methods and a combinational approach to changing capacitance, to provide a flexible method of power control, for a system such as that illustrated in FIGS. 4A and 4B; the flow of power to the light source illustrated therein may generally be characterized by the following.

1. Electrical power at a service distribution cabinet 30 is divided among the breakers, and power at a breaker A 31 travels to contactor module A 41 in a control/contactor cabinet 40 via a power line 21.
   a) Remote operation of the contactor modules may be enabled by a moderator module 42 and antenna 43.
2. Electrical power from the control/contactor cabinet 40 travels to a pole cabinet 50 via a power line 21.
3. Electrical power at the pole cabinet 50 travels through a disconnect switch 52, ballast 51, a capacitor bank 53, and powers the light source 61.

Optionally, earth grounding to protect against adverse electrical effects, such as lightning, may be provided via earth grounds 80 connected to the pole cabinet 50 according to well known practices. Equipment grounding may be provided via equipment ground 81 connected to the distribution cabinet 30 and via equipment ground wire 82 according to well known practices.

Figure 4A:
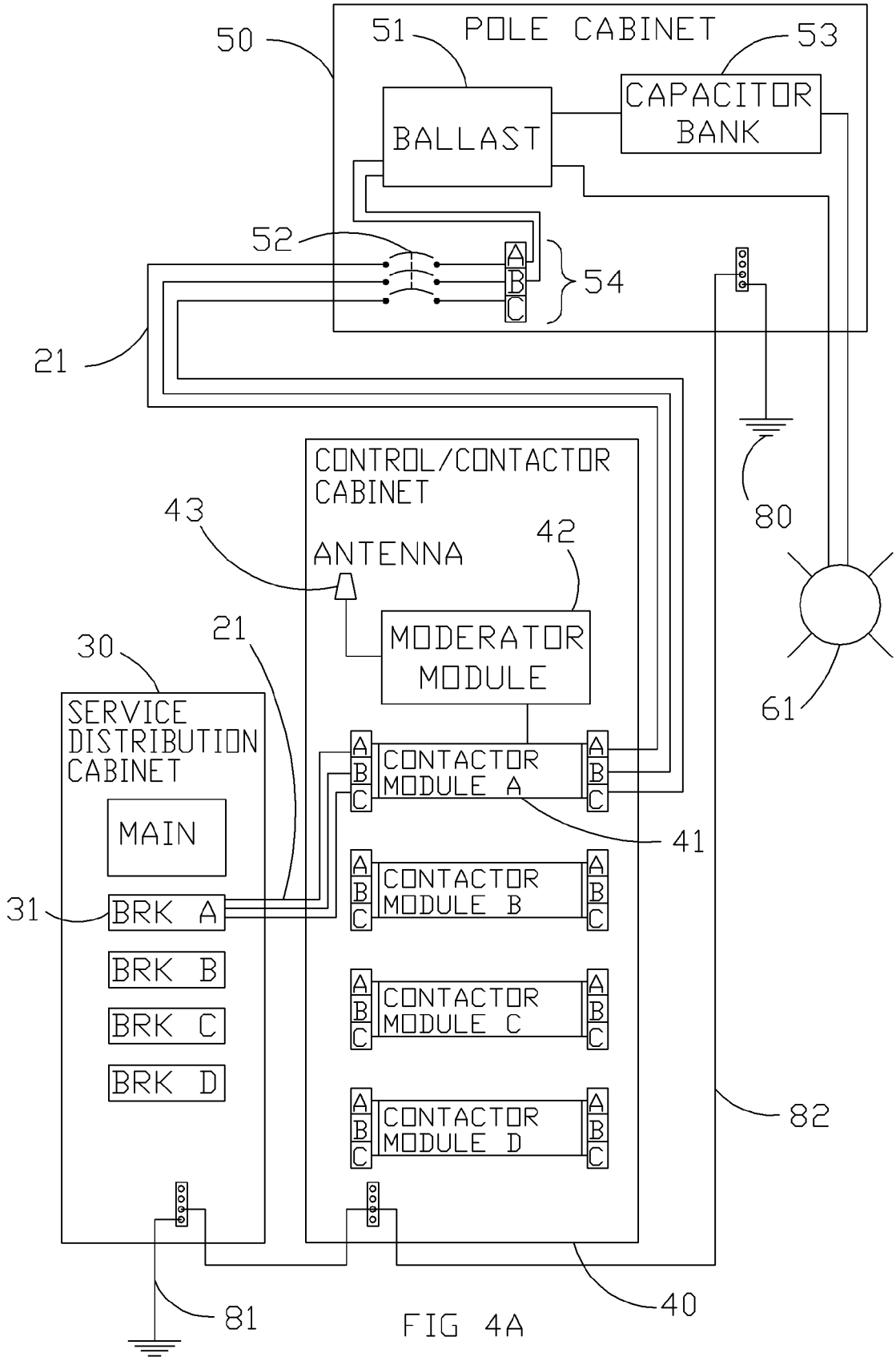
FIG. 4A illustrates a typical electrical system for a traditional ballast-capacitor-lamp type load.
Figure 4B:
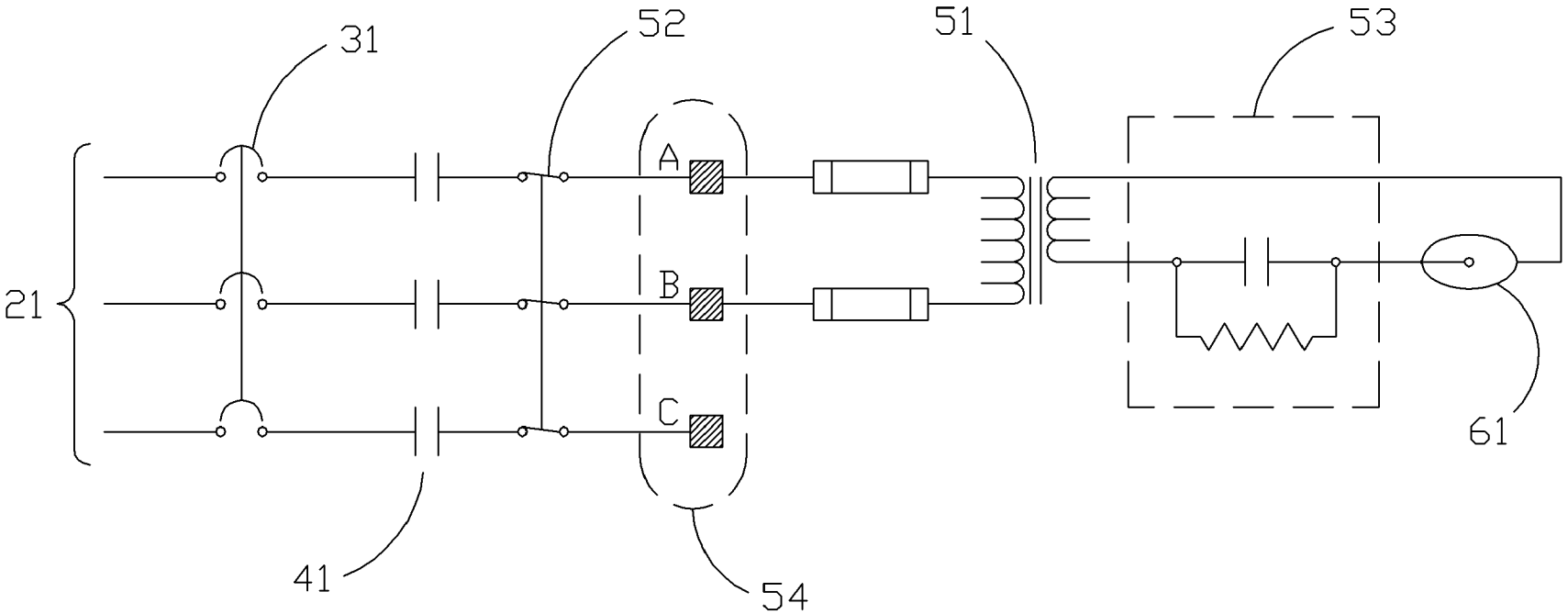
FIG. 4B illustrates the general light source circuit for the system illustrated in FIG. 4A.

FIG. 4B illustrates the general light source circuit for the electrical system illustrated in FIG. 4A. With respect to FIG. 4B, the incoming power lines 21 are 480 volt, three-phase lines, though this is by way of example and not by way of limitation. Further, the ballast 51 is a lead-peak ballast, though as will be demonstrated, alternate ballast types may be utilized. The capacitor bank 53 contains only one capacitor as illustrated; however, as will be demonstrated, multiple capacitors may be utilized to attain various power levels. Also, it is of note that a single light source circuit is illustrated in FIG. 4B; however, it is possible for a plurality of light source circuits to be connected at the terminal blocks 54.

U.S. Pat. No. 7,176,635, incorporated by reference herein, addresses power level adjustments using methods such as adding capacitors to the capacitor bank 53 to control capacitance to the light source 61, or alternatively adding taps to the ballast 51 to control line voltage to the light source 61, or alternatively adding taps to the power source supplying power line 21 to the electrical system to control line voltage to the primary side of the ballast 51, and therefore, the light source 61. The methods described in U.S. Pat. No. 7,176,635 address LLD concerns by making sequentially additive power adjustments at pre-determined intervals based on known depreciation curves for a particular light source, primarily to maintain a constant or near-constant light output. The methods in U.S. Pat. No. 7,176,635 may benefit from the improved switching methods described herein such that the accuracy of switch timing is improved and remote operation of switching methods is practical.

U.S. patent application Ser. No. 12/035,994, incorporated by reference herein, discusses alternative methods of adding capacitance to systems such as that illustrated in FIGS. 4A and 4B. In one example, an electronic timer connected to a switch is envisioned for each capacitor in the capacitor bank 53. The electronic timer/switch system replaces the motor/cam system envisioned in U.S. Pat. No. 7,176,635. While the methods described in U.S. patent application Ser. No. 12/035,994 address accuracy of switch timing, remote operation is not addressed. Further, U.S. patent application Ser. No. 12/035,994 addresses LLD concerns using the same sequentially additive method as U.S. Pat. No. 7,176,635. Still further, the timing mechanism is not particularly robust as electronic timers located in such close physical proximity to high voltage and high current switching may be susceptible to electrical surges.

U.S. patent application Ser. No. 11/842,853 issued as U.S. Pat. No. 7,956,551 on Jun. 7, 2011, and incorporated by reference herein, addresses power level adjustments using methods as described in U.S. Pat. No. 7,176,635, but also addresses dimming of circuits to address energy conservation as in the aforementioned U.S. Pat. No. 4,994,718, incorporated by reference herein. However, the methods described in U.S. Pat. No. 7,956,551 address remote operation and a more flexible approach to changing capacitance for the MULTI-WATT™ portion of the light source circuit only; the SMART LAMP® portion of the circuit still makes sequentially additive power adjustments at pre-determined intervals based on known depreciation curves for a particular light source.

Also utilized in the current state of the art are methods for adjusting power to a light source via electronic/solid-state means (e.g. microprocessors, transistors, etc.). While such means may improve the accuracy of switch control, electronic/solid-state means of adjusting power to a light source are susceptible to electrical surges much like the electronic timer in U.S. patent application Ser. No. 12/035,994. Some of the improved switching methods described herein comprise electronic control coupled with a solenoid switching mechanism that is more robust than use of current state of the art electronic/solid-state switching mechanisms.

The exemplary embodiments described herein improve upon the current state of the art to create a flexible method of power control to a light source by taking a combinational approach to changing capacitance, improving the robustness and timing of existing switching methods, and making remote operation of the switching methods practical. Aspects according to the present invention may be applied to a variety of light source circuits and electrical systems, particularly those in the aforementioned current art.

1. Combinational Capacitance

Figure 2:
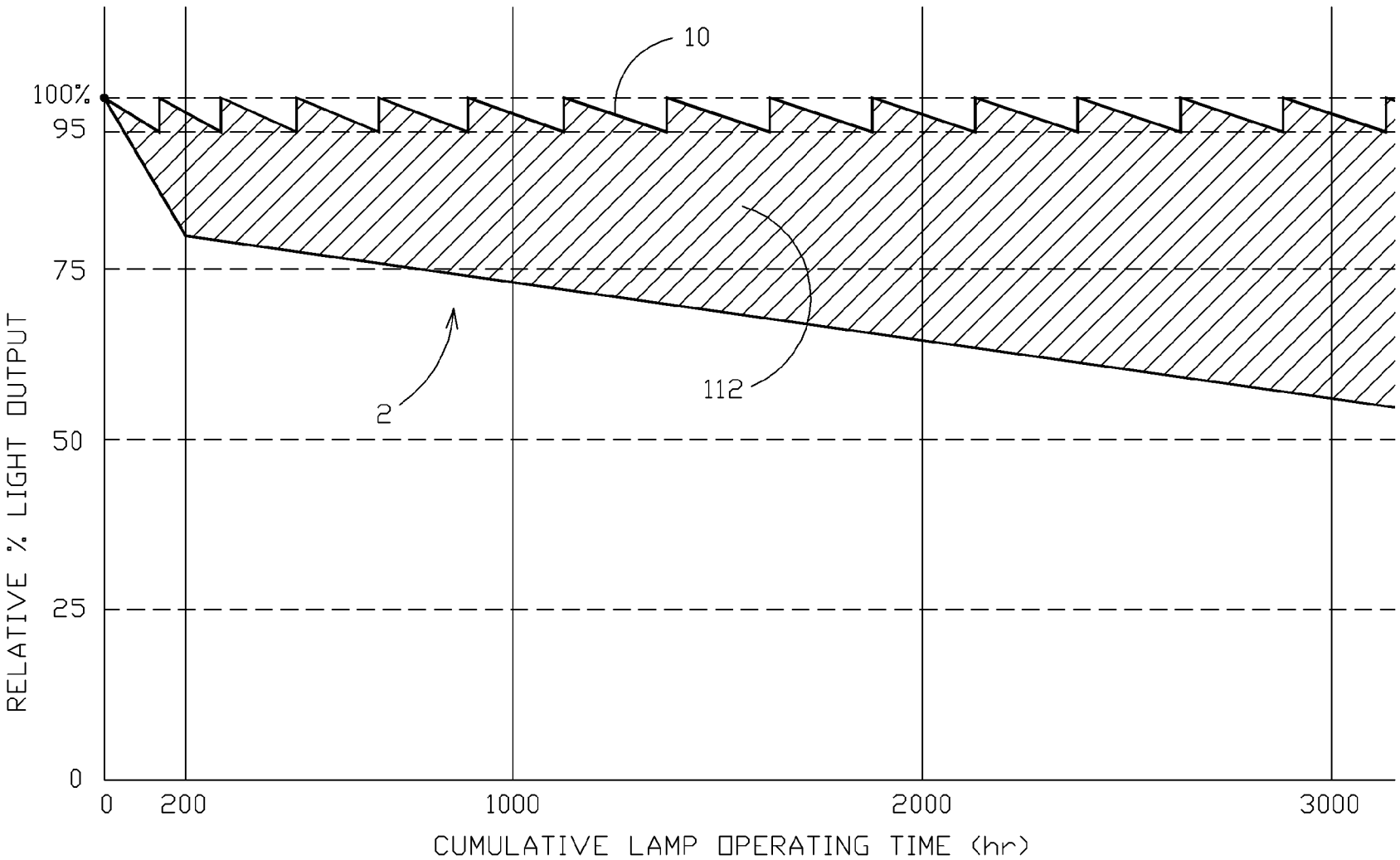
Figure 3:
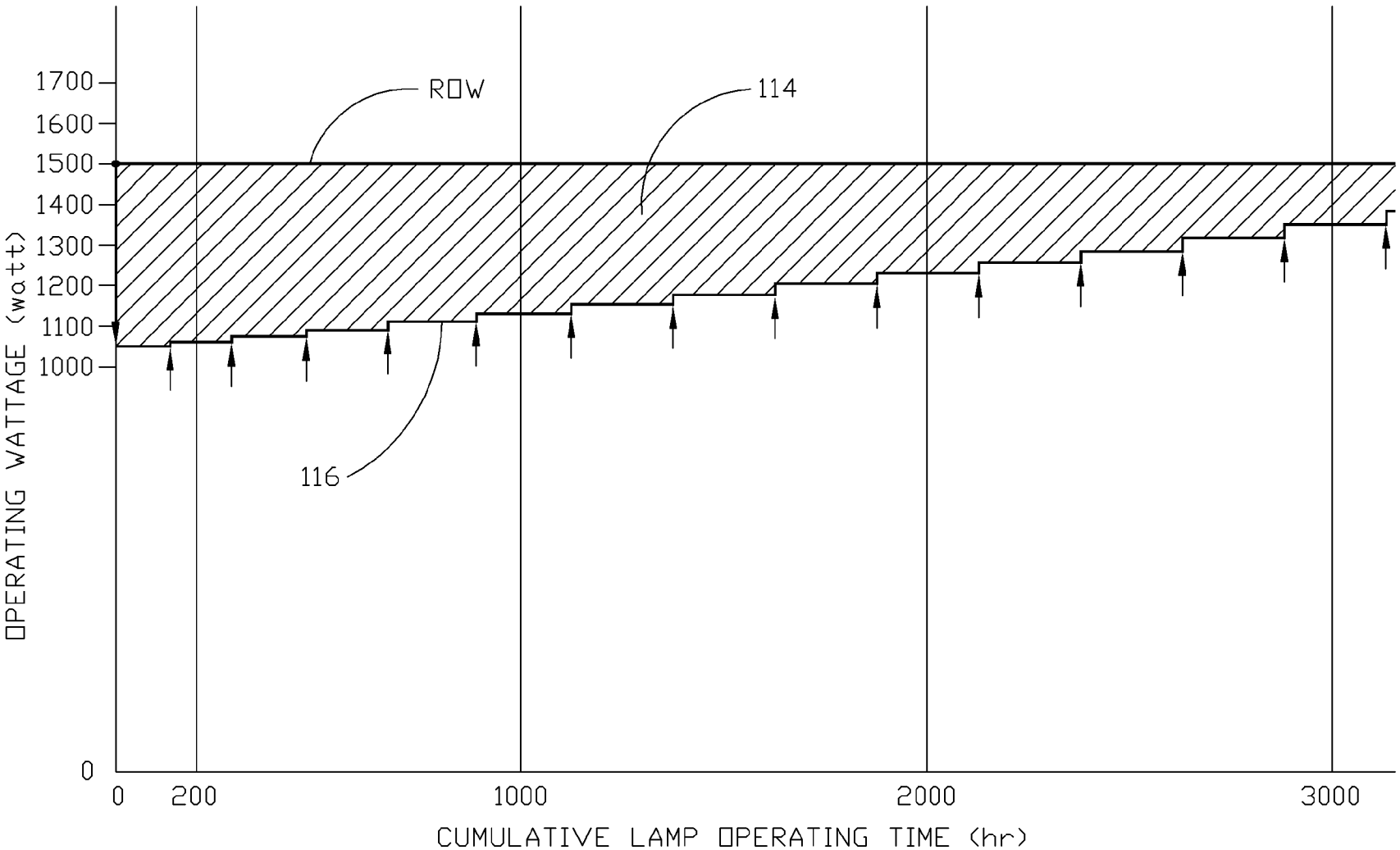

A typical embodiment of the invention comprises a capacitor bank as in 53, FIG. 4B, containing a plurality of capacitors connected in parallel to each other, with the bank connected in series with the light source 61, FIG. 4B; capacitance values of each capacitor may be the same or may differ. Capacitors may be switched in and out (see switches SW1-4 in series with capacitors C1-4 in FIG. 5) of the circuit for the purpose of preserving the quantity of light output (e.g. maintaining constant or near-constant light output, the degradation of which may be due to LLD—see FIG. 2) by generally making small increases to the overall system capacitance. Alternatively, capacitors may be switched in and out of the circuit for the purpose of conserving energy (e.g. dimming the circuit during the initial operation of a light source—see FIG. 3) by generally making large decreases to the overall system capacitance; or for other purposes not described herein. By way of one possible example, and not by way of limitation, Table 1 illustrates possible combinations of some possible capacitance values for the purpose of preserving the quantity of light output. Table 1, in this example, is in the context of a light source having the following relevant properties or characteristics:

1. metal halide HID lamp;
2. of 1500 watt ROW;
3. having LLD characteristics; and
4. having a desired light output which correlates to an operating wattage given the LLD characteristics of the lamp.

Figure 5:
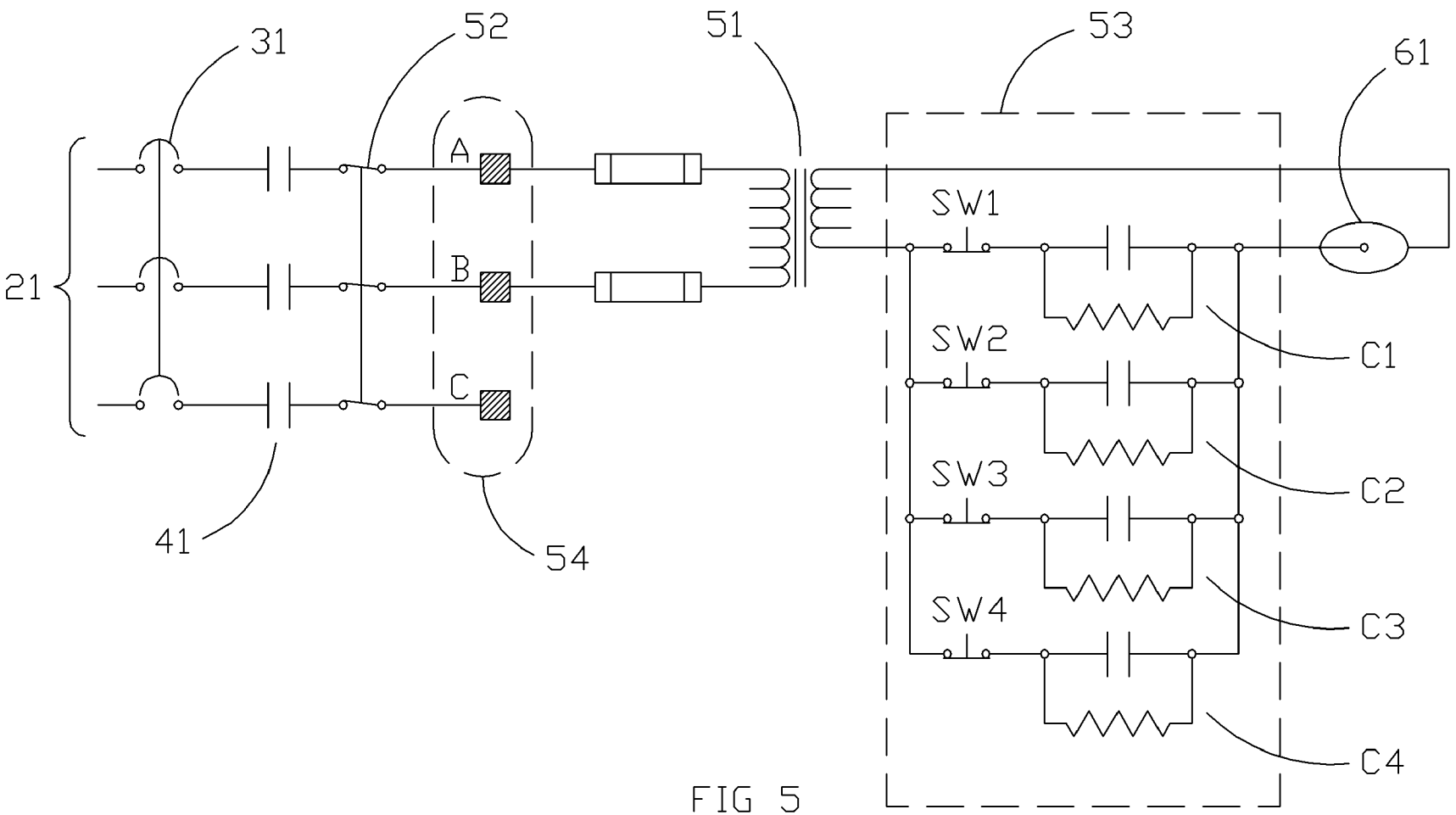
FIG. 5 illustrates the general light source circuit as in FIG. 4B with the capacitor bank modified to include multiple capacitors.

Capacitors C1, C2, C3, and C4 are independently switchable or in combinational fashion in parallel with each other in the light source circuit (e.g. see FIG. 5). As will be appreciated by those skilled in the art, the values of Table 1 might be the same or change depending on any number of factors, including light source.

By "combinational", it is meant that any one or more of the parallel capacitors in the bank 53, and thus their capacitance values, may be independently selected for electrical connection into the light source circuit to provide an operating power level to the light source; specifically that (a) any one of the plural capacitors in the bank 53 may be selected or (b) any combination of two, or more if more than two in the bank 53, may be selected/combined. As is well known, connecting any two or more capacitors in parallel will have an additive effect on total capacitance value (i.e. it will be the sum of the capacitance values of the individual capacitors). The term "combinational" includes that ability to add or combine any two or more capacitors and associated capacitance values to the light source circuit at any time, but also includes selecting and adding just one capacitor and associated capacitance value to the light source circuit at any time. Any single capacitor may be selected at any time, or any two or more capacitors may be.

TABLE 1

| Switching State | Cap 1 (0.5 μf) | Cap 2 (1 μf) | Cap 3 (2 μf) | Cap 4 (4 μf) | Total Capacitance Increase |
|---|---|---|---|---|---|
| 1 | | | | | 0 μf |
| 2 | x | | | | 0.5 μf |
| 3 | | x | | | 1 μf |
| 4 | x | x | | | 1.5 μf |
| 5 | | | x | | 2 μf |
| 6 | x | | x | | 2.5 μf |
| 7 | | x | x | | 3 μf |
| 8 | x | x | x | | 3.5 μf |
| 9 | | | | x | 4 μf |
| 10 | x | | | x | 4.5 μf |

The capacitance values in Table 1 may be applied to the capacitor bank 53 of FIG. 4B, to produce the light source circuit illustrated in FIG. 5. With respect to Table 1, Capacitor 1 corresponds to C1, FIG. 5, Capacitor 2 corresponds to C2, FIG. 5, and so on. For the sake of brevity, the switching mechanism and switching control functions of each capacitor comprise a simple push-to-break switch (see switches SW1-4); FIG. 5 is intended only to illustrate the effect of adding capacitors to the capacitor bank 53. Table 1 illustrates ten switching states, but one skilled in the art would know that many more switching states are readily achieved by other combinations of capacitors C1-C4.

2. Improved Switching Methods

To achieve a combinational approach to changing capacitance, the switching methods must allow any combination of capacitors to be engaged or disengaged at any given time. As may be seen from Table 1, adjusting power from one level to another may require some capacitors to be disconnected and a different set of capacitors to be engaged simultaneously. In addition to simultaneous switching, it may be beneficial for the switching methods to be rapid and accurate so that precise changes in capacitance may occur, and to prevent electrical current from arcing across the gap between the switch and the capacitor switch contact, thus leading to contact damage. Further, it may be beneficial for the switching methods to be controlled remotely to provide flexibility; however, it may also be beneficial for the control components of the switching methods to be electrically isolated such that the overall assembly is robust.

Figure 6:
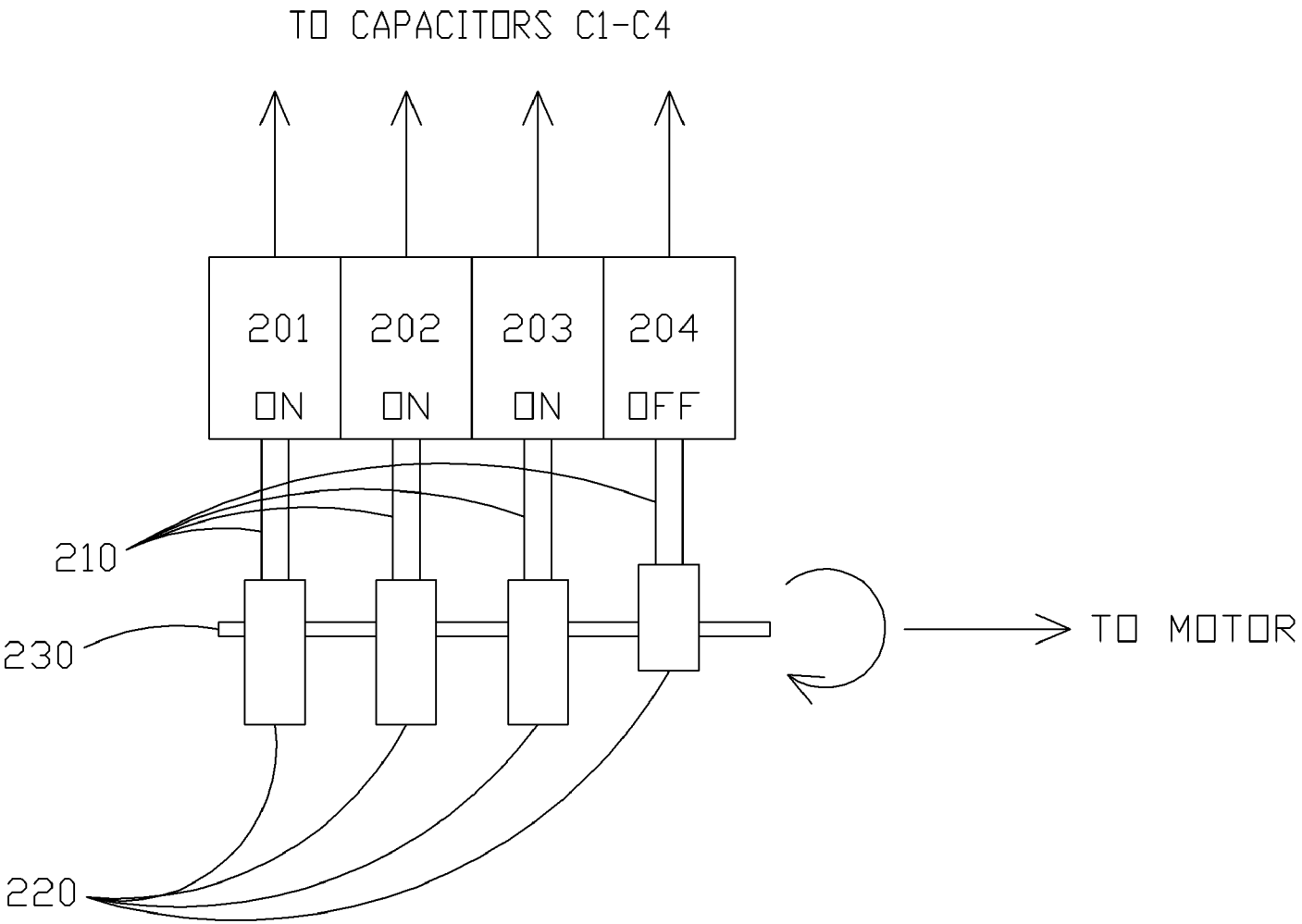
FIG 6 (PRIOR ART)
FIG. 6 illustrates prior art in which capacitance changes are enabled by a cam/motor system.

An example of a current art switching method utilizing the capacitor bank 53, FIG. 5, is illustrated in FIG. 6 in which four capacitors are switched in an electrical system to increase power to the light source over time. Each of the four capacitors (C1-4) is connected to a switch contact 201-204 (each a part of a corresponding push-to-break switch as in SW1-4) that is engaged by movement of a spring-loaded pushrod 210; the switch contact 201-204 may be of any currently commercially available type or design (e.g. dry contact). As illustrated in FIG. 6, an electric motor attached to an armature 230 rotates cams 220 that hold the switch contacts 201-204 open by pushing on the spring-loaded pushrods 210. As the cams 220 rotate, constant pressure on the pushrods 210 maintains the open switch contact position until a cam profile releases pressure on the pushrod 210 and allows the switch contact 201-204 to close. For example, when a cam profile releases a pushrod 210, as for switch contacts 201-203, the switch contacts are on and capacitance from the associated capacitors are added to the electrical system.

The system illustrated in FIG. 6 rotates in a single direction with cams 220 designed to engage each switch only once until the unit is reset and the process starts over (i.e. capacitance is added sequentially). Further, the speed and accuracy of the capacitance changes are limited by the physical tolerances of the cams 220 and motor assembly. Due to the inflexibility of the system illustrated in FIG. 6, even if remote control functions were available, their usefulness would be limited to operation of the motor.

Figure 7:
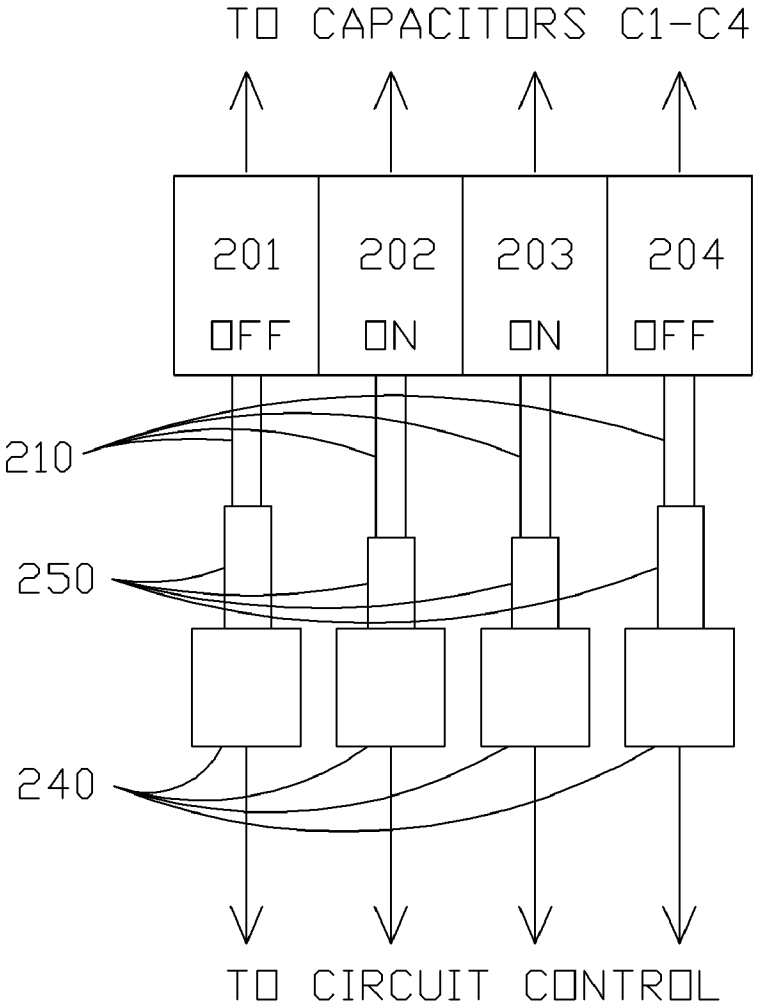
FIG. 7 illustrates aspects of the invention in which capacitance changes are enabled by a solenoid switching system.

A generalized exemplary embodiment according to at least some aspects of the present invention is illustrated in FIG. 7 in which plural (here four) capacitors are switched in and out of an electrical system to adjust the power. Similar to the system illustrated in FIG. 6, each of the four capacitors is connected to a switch contact 201-204 that is engaged by movement of a spring-loaded pushrod 210; the switch contact 201-204 may be of any currently commercially available type or design (e.g. dry contact). Solenoids 240 are used in place of the cam/motor assembly illustrated in FIG. 6 to actuate the pushrods 210; the solenoids 240 may be of any currently commercially available type or design (e.g. thrust solenoid). As illustrated in FIG. 7, the solenoids 240 receive an actuation signal from a circuit control (see e.g. circuit control 60, FIG. 8) to actuate the switch contacts 201-204 open by pushing on the spring-loaded pushrods 210. A latching mechanism 250 may be used to ensure the switch contact position is maintained until the solenoids 240 actuate the pushrods 210 again. One example of a latching mechanism used in an assembly in which activation of a solenoid produces a latched state is described in U.S. Pat. No. 4,623,860, incorporated by reference herein. One example of a latching mechanism used to actuate and retract a writing element in a writing instrument is described in U.S. Pat. No. 6,340,261, incorporated by reference herein. In both examples, utilization of the latching mechanism in the present exemplary embodiment may allow the solenoid to be de-powered after latching. The latching mechanism may be integral to the pushrod 210, a separate device, or integral to the solenoid (e.g. latching solenoid). One example of a latching solenoid is any of the 65 Latching Series from Dialight BLP, LTD. of Newmarket, Suffolk, U.K. The latching mechanism could alternatively be omitted from the design for certain solenoid types, however, this would generally require that power be maintained to the solenoid while latched, which may not be desirable. The speed and accuracy of the switching method is improved over current art as it is no longer limited by the tolerances of the cams and motor. Additionally, a subset of the switch contacts 201-204 may be disconnected while others are engaged simultaneously as each switch contact may be controlled independent of the others via solenoid 240.

Figure 8:
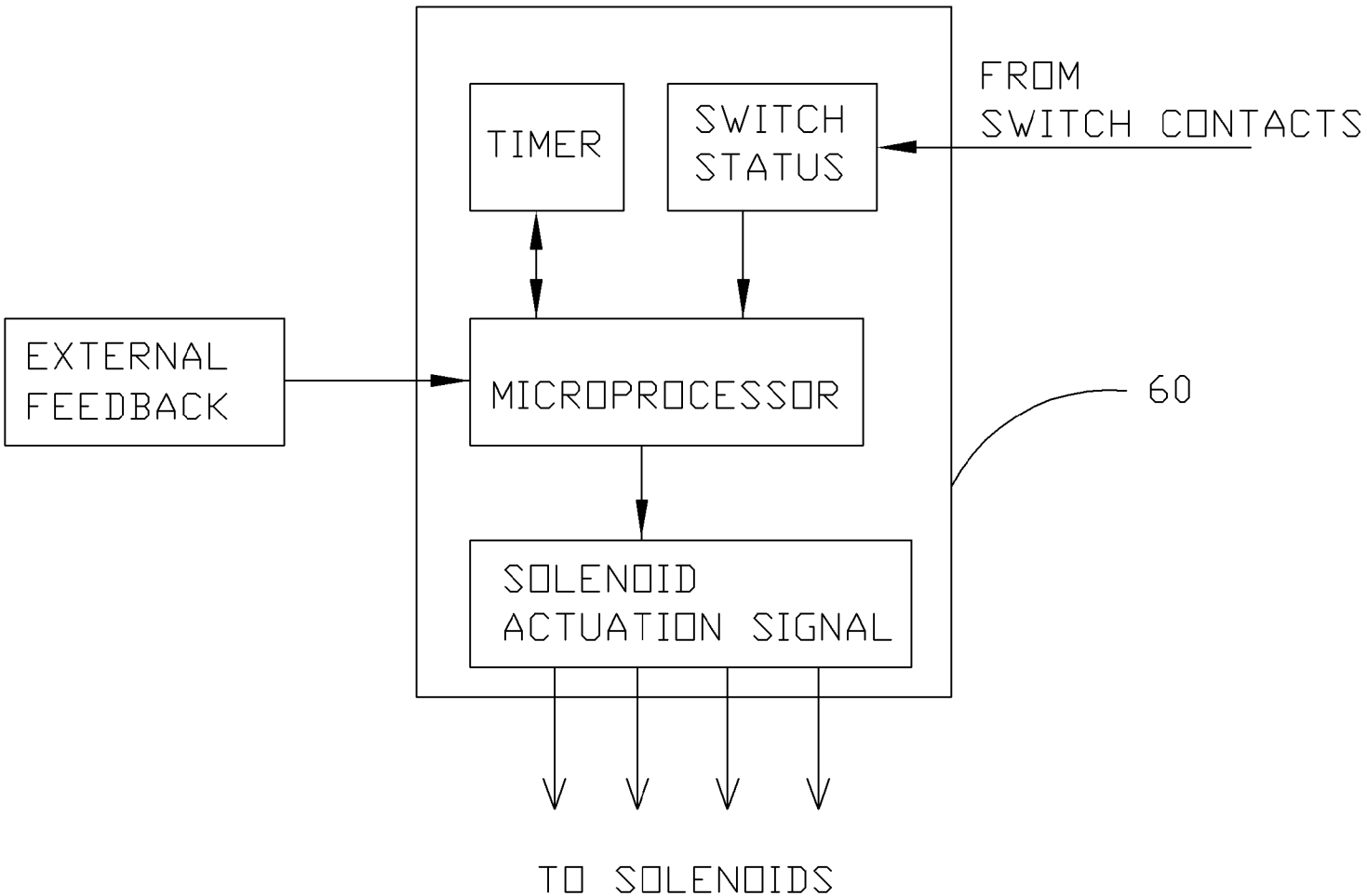
FIG. 8 illustrates aspects of the invention in which a circuit control operates the solenoid switching system illustrated in FIG. 7.

Operation of the solenoids 240 illustrated in FIG. 7 may be optionally enabled by a circuit control as is illustrated in FIG. 8. A timer signals a microprocessor (e.g. model PIC18F4550 from Microchip of Chandler, Ariz., U.S.A.) to send an actuation signal to the solenoids at predetermined intervals which, in turn, allows the solenoids to actuate and engage the pushrods. However, the timer in the circuit control illustrated in FIG. 8 may be supplemented by feedback (see "EXTERNAL FEEDBACK" in FIG. 8) from external devices (e.g. a photocell used to determine progression of LLD) or control commands from a user interface (e.g. a manual dimming switch located near the light source) to make power adjustments for purposes described herein or otherwise. Other examples of feedback from external devices include but are not limited to sensed light levels (whether at the lamp or a target area) from devices other than photocells (e.g. photodiodes), sensed light levels from other sources of illumination (e.g. other light source circuits at the same site location), temperature, humidity, wind conditions (e.g. speed, direction, etc.), or other feedback deemed useful to the application. Feedback from the switch contacts may ensure correct switching and therefore, capacitance values. One feedback method is a simple electrical signal transmitted to the circuit control 60 when switch contacts are engaged and associated capacitors, and therefore capacitance, are added to the light source circuit.

The improved switching methods illustrated in FIGS. 7 and 8 utilize a robust mechanical component (solenoids) while simultaneously utilizing rapid and accurate electronic control (circuit control) that are isolated from high voltage and high current switching, and therefore, are less susceptible to electrical surges. The electrical isolation may be by well known methods, including physical separation of the circuit control from the switching components by comparatively electrically insulative barriers.

C. Exemplary Method and Apparatus Embodiment 1

Figure 9A:
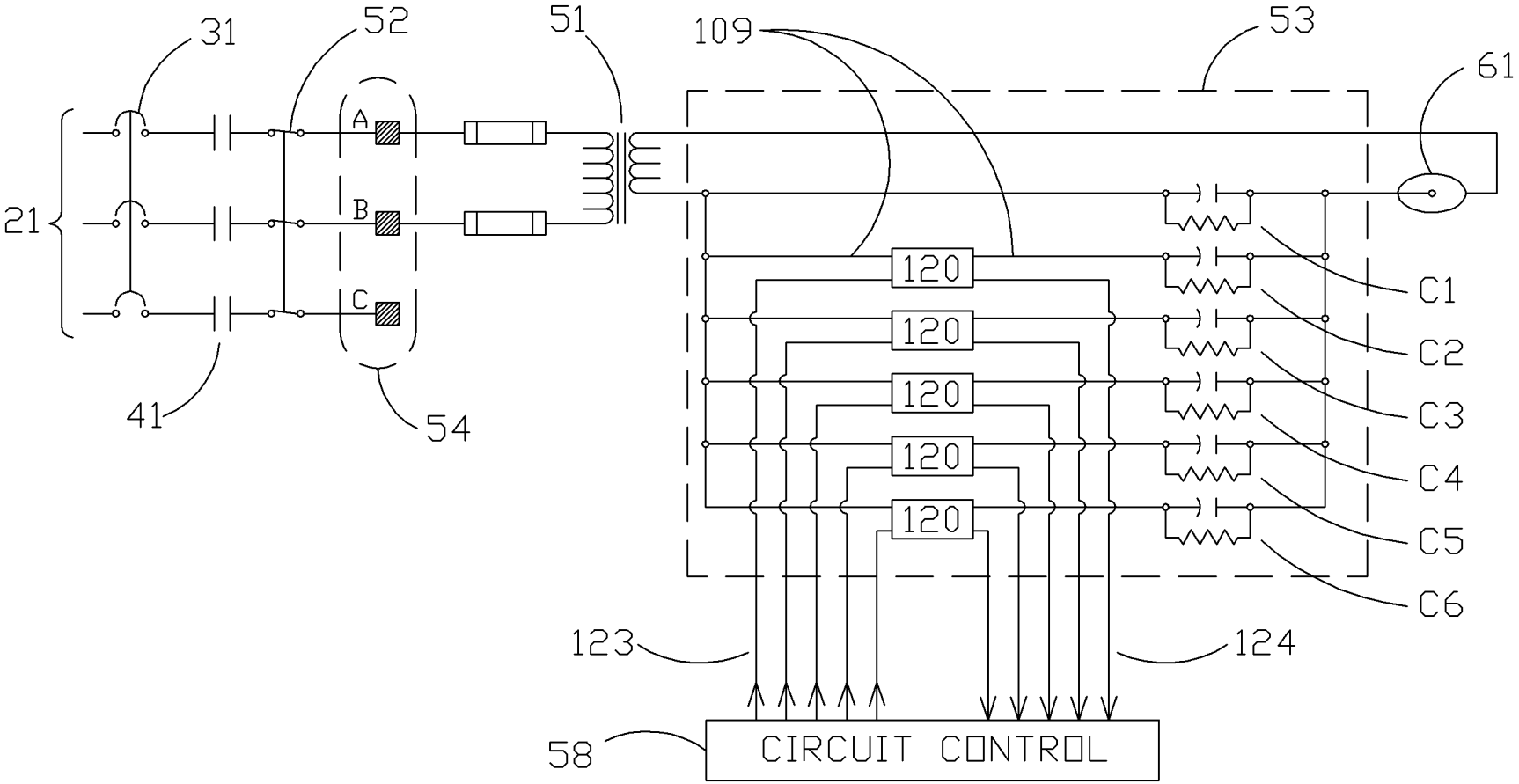
FIG. 9A illustrates an exemplary embodiment in which a light source circuit is enabled with a solenoid switching system and circuit control.
Figure 10A:
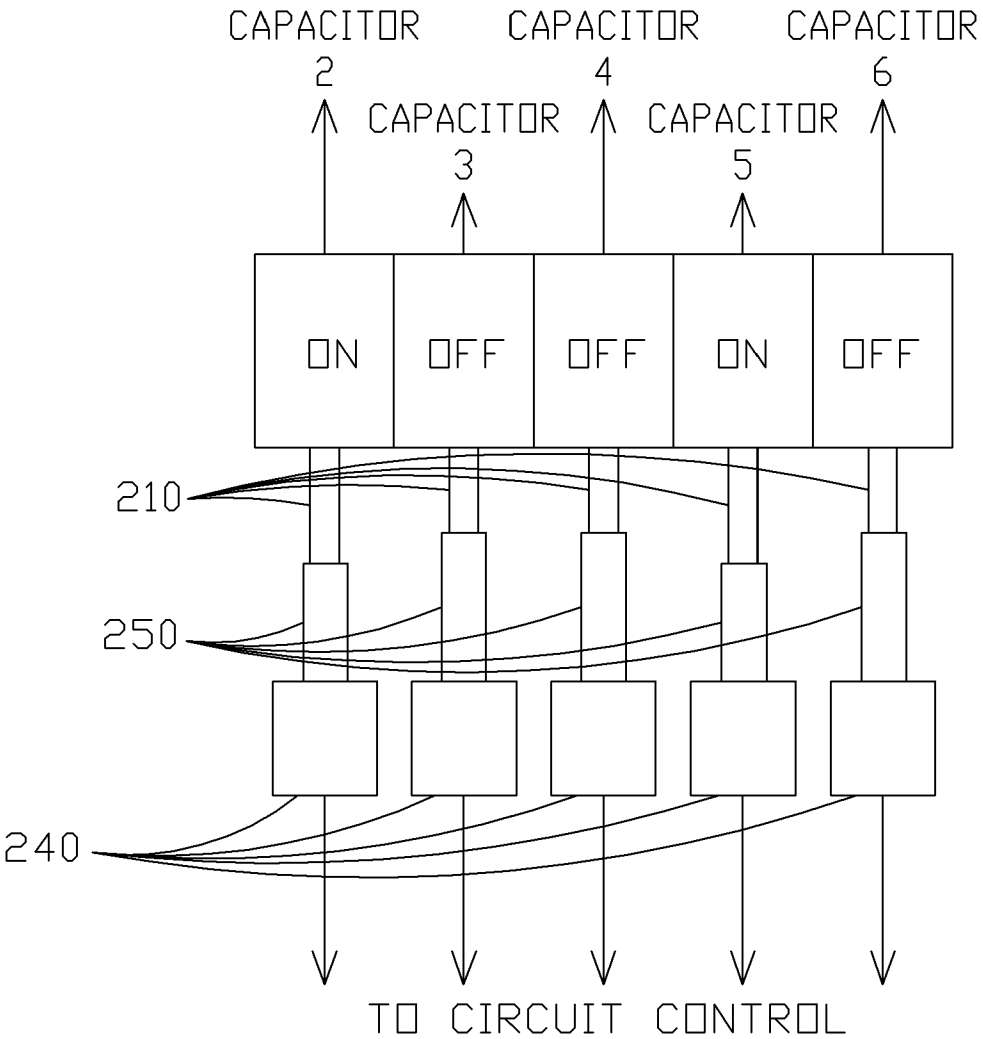
FIG. 10A illustrates an exemplary embodiment in which capacitance changes are enabled by the solenoid switching system illustrated in FIGS. 9A and 9B.
Figure 10B:
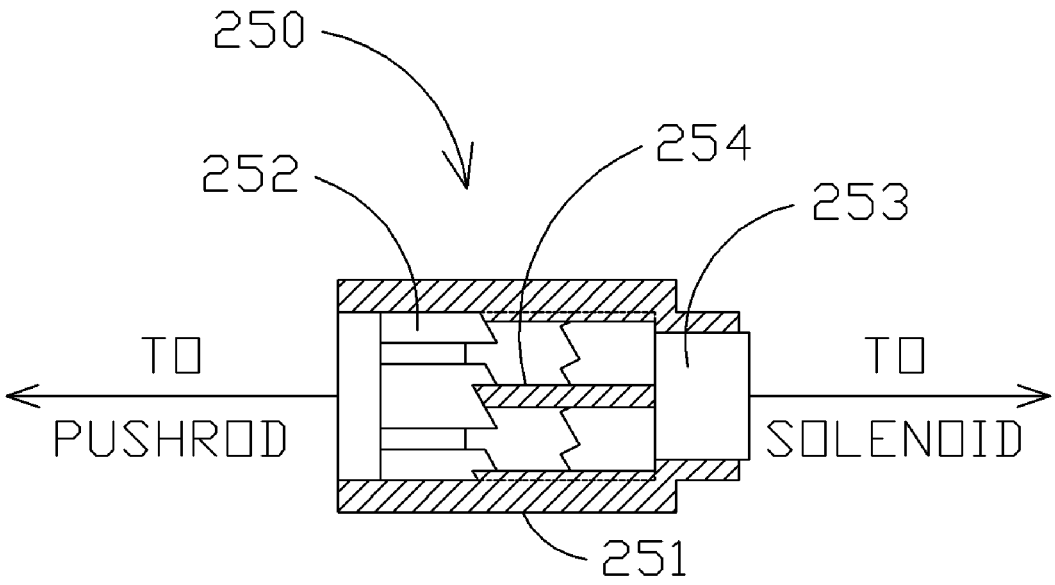
FIGS. 10B and 10C illustrate a detailed view of the latching mechanism illustrated in FIG. 10A.
Figure 10C:
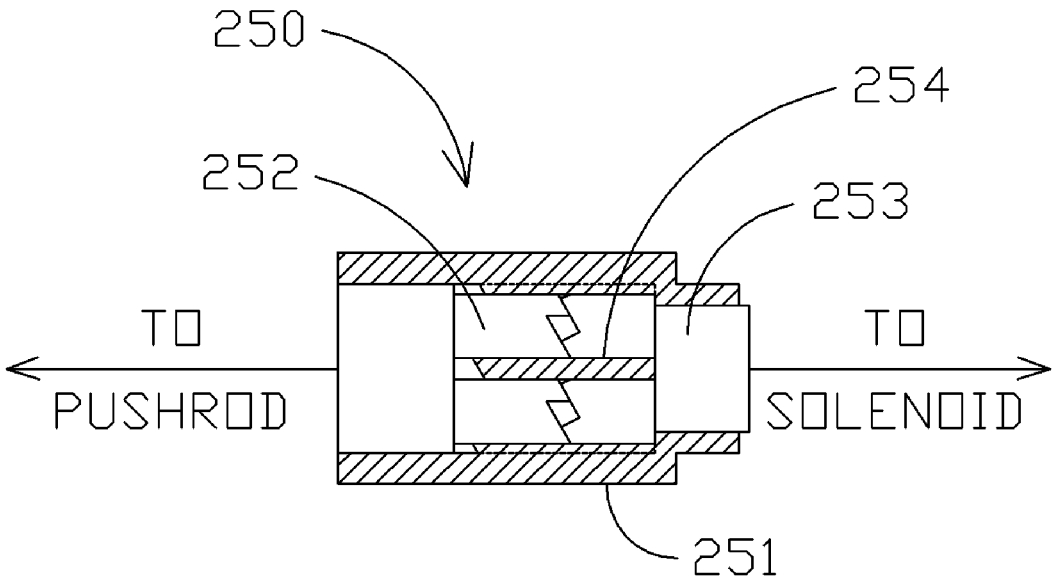
Figure 11A:
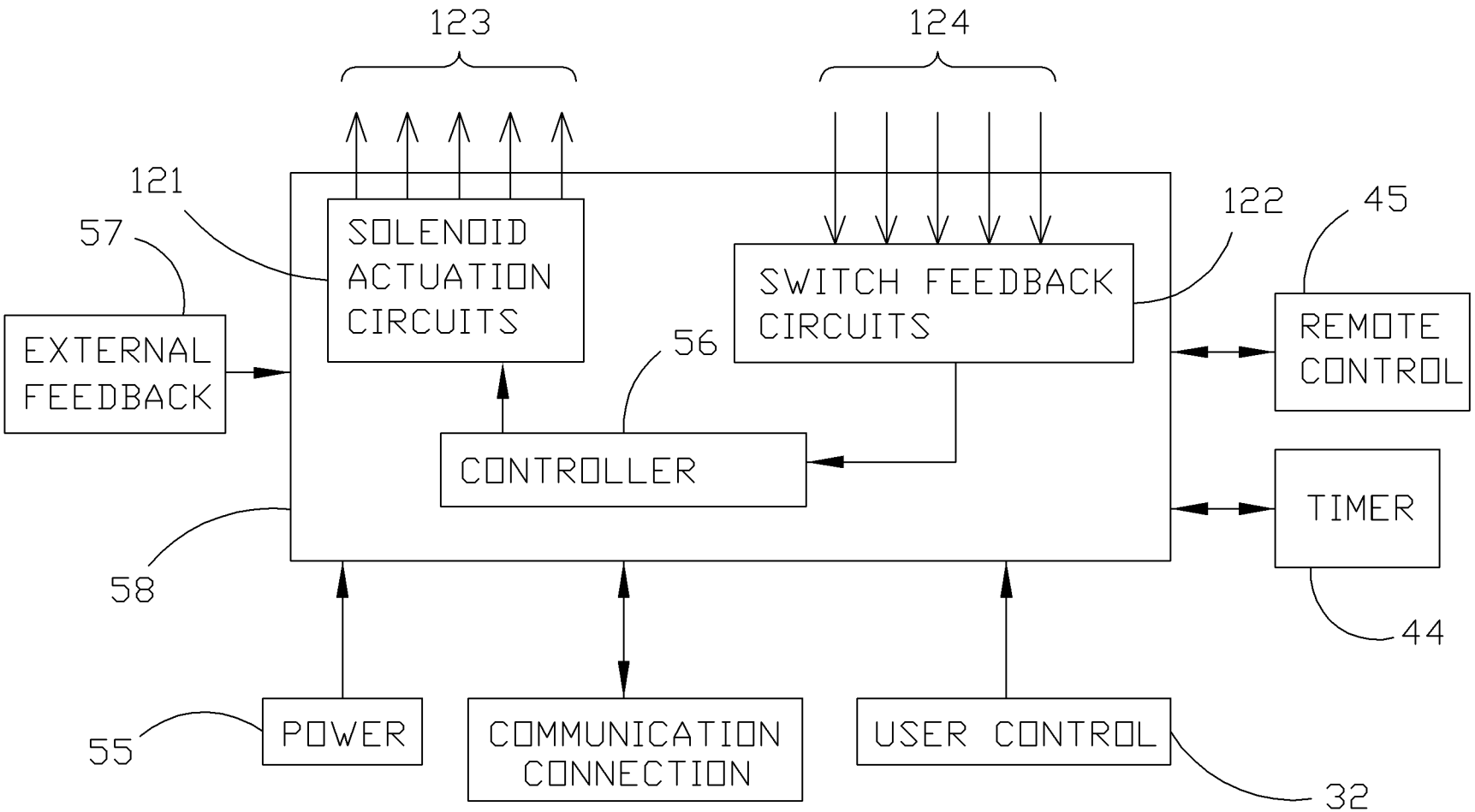
FIG. 11A illustrates an exemplary embodiment in which the circuit control illustrated in FIG. 9A is detailed.
Figure 11B:
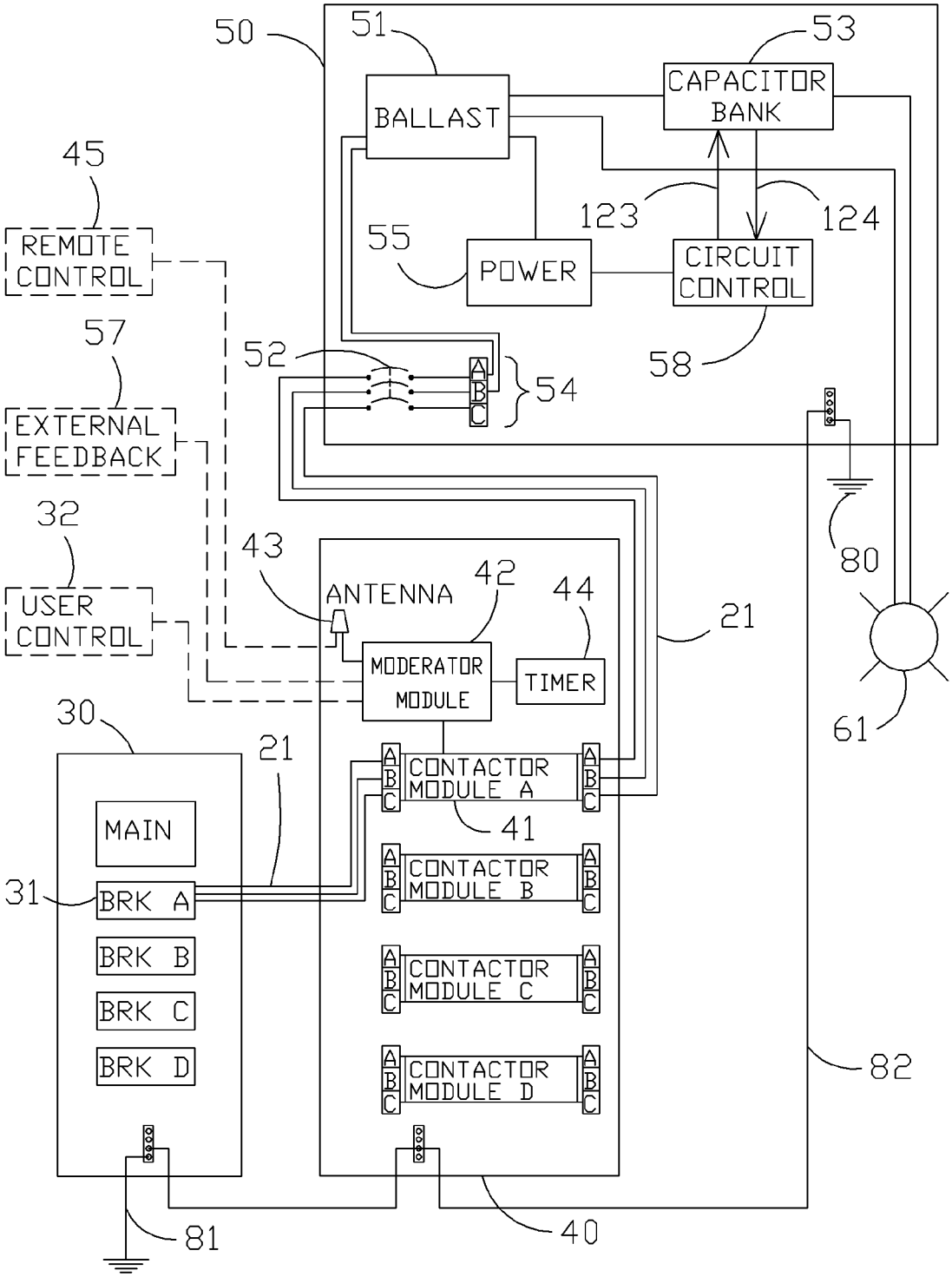
FIG. 11B illustrates an exemplary embodiment in which the circuit control in FIG. 11A is installed in the electrical system illustrated in FIG. 4A.

A more specific exemplary embodiment, utilizing aspects of the generalized example described above, will now be described. An electrical system operating a capacitor bank utilizing a plurality of capacitors as illustrated in FIG. 9A, to achieve the capacitance values illustrated in Table 2, is enabled with a solenoid switching method as illustrated in FIGS. 9B and 10A-C; and operated by a circuit control as illustrated in FIGS. 11A and 11B.

With respect to Table 2, Capacitor 1 is a base capacitor that typically remains in the circuit; note Capacitor 1 (as is illustrated by C1, FIG. 9A) is shown integral to the light source circuit. Capacitor 2 (as is illustrated by C2, FIG. 9A) is of a relatively large capacitance and may generally be switched out via solenoid switch 120, FIG. 9A (e.g. when dimming the circuit for purposes of energy conservation or otherwise). Capacitors 3-6 (as are illustrated by C3-C6, FIG. 9A) are of relatively low capacitance and may generally be switched in and out via a corresponding solenoid switch 120, FIG. 9A (e.g. when preserving the quantity of light output for purposes of maintaining constant or near-constant light output or otherwise). Note that for the sake of brevity Table 2 illustrates ten switching states, but one skilled in the art would know that many more switching states are possible.

TABLE 2

| Switching State | Cap 1 (20 μf) | Cap 2 (8 μf) | Cap 3 (4 μf) | Cap 4 (2 μf) | Cap 5 (1 μf) | Cap 6 (0.5 μf) | Total Capacitance |
|---|---|---|---|---|---|---|---|
| 1 | x | x | | | | | 28 μf |
| 2 | x | x | | | | x | 28.5 μf |

TABLE 2-continued

| Switching State | Cap 1 (20 μf) | Cap 2 (8 μf) | Cap 3 (4 μf) | Cap 4 (2 μf) | Cap 5 (1 μf) | Cap 6 (0.5 μf) | Total Capacitance |
|---|---|---|---|---|---|---|---|
| 3 | x | x | | | x | | 29 μf |
| 4 | x | x | | | x | x | 29.5 μf |
| 5 | x | x | | x | | | 30 μf |
| 6 | x | x | | x | | x | 30.5 μf |
| 7 | x | x | | x | x | | 31 μf |
| 8 | x | x | | x | x | x | 31.5 μf |
| 9 | x | x | x | | | | 32 μf |
| 10 | x | x | x | | | x | 32.5 μf |

Switching of the capacitors in the light source circuit illustrated in FIG. 9A is enabled by the solenoid switching method illustrated in FIGS. 9B and 10A-C. With respect to FIG. 10A, the positioning of the pushrods 210 is such that the circuit capacitance reflects Switching State 3 from Table 2; note the base capacitor (Capacitor 1) is not illustrated in FIG. 10A as Capacitor 1 is integral to the circuit. Addition of capacitance to the circuit may be characterized by the following.

1. Solenoids 240 receive an appropriate actuation signal 123, FIG. 9B, from the circuit control 58, FIG. 11A.
   a. Solenoids may be either AC or DC driven. DC driven solenoids may be preferable when noise reduction, precise timing of actuation, or immunity to overheating through incomplete actuation is desirable. Such solenoids may be relatively small in size (e.g. on the order of a few (in one example 2 to 3) inches or so in length, width, and height (including the extended thrust pin)).
2. The solenoids 240 are energized for a finite period (commonly referred to as pulsed) during which time the solenoid thrust pin (not shown) engages the latching mechanism 250.
   a. Solenoids may be any of a variety of currently commercially available type or design. Solenoid composition (including the aforementioned thrust pin) is well known in the art and for the sake of brevity is not illustrated in FIG. 10A. Pulsed solenoids may be preferable when physical space is limited or it is desirable to limit power consumption.
3. The latching mechanism 250 releases the spring-loaded pushrod 210 which allows the switch contacts to close and current to flow through the corresponding capacitor, thus adding capacitance to the system.
   a. The latching mechanism may be of any of a variety of currently commercially available type or design. One example is a sliding latching mechanism commonly utilized in laptop displays, such as that on the Excelente E515 A907 laptop from Ashton Digital Corporation of Milpitas, Calif., U.S.A. Another example is a plunger latching mechanism commonly utilized in window and door repair, such as model PL 7777 from Slide-Co. of Redlands, Calif., U.S.A. Or it may be custom built for this application. As illustrated in FIG. 10B, a latching mechanism 250 comprises a housing 251 in which a driver 253, when pushed by the solenoid thrust pin, rotates a spinner 252 which sits on inner channels 254 of the housing 251 and holds the pushrod 210, FIG. 10A, in position (see FIG. 10B). When the driver 253 is pushed by the thrust pin again, the spinner 252 rotates back and releases the pushrod 210, FIG. 10A, (see FIG. 10C). The latching mechanism illustrated in FIGS. 10B and 10C is well known in the art of retractable writing implements, such as ball point pens Like a retractable ball point pen, the latching mechanism 250 is operatively connected to the solenoid thrust pin so that when the solenoid thrust pin is in retracted position, the latching mechanism 250 is unlatched. But when the solenoid thrust pin moves from the retracted towards a fully extended position, when the solenoid is actuated or pulsed, the driver 253 of the latching mechanism moves linearly in kind, causing the spinner 252 to both move linearly in kind but at the same time rotate about its longitudinal axis according to the channels 254 within the housing 251. This causes the spinner 252 to move linearly in kind to physically close the switch contact associated with that actuated solenoid. The spinner 252 includes structure that cooperates with structure in the latching mechanism housing 251 such that when the spinner 252 is moved sufficiently along the housing and rotated to a certain rotational position, the spinner latches (i.e. rests upon the channel 254 within the housing 251—see FIG. 10B) and stays in that extended position and stays latched even when the solenoid thrust pin returns to retracted position (which would occur if the solenoid is momentarily pulsed). The switch contact is thus closed and the corresponding capacitor from bank 53 combined into the light source circuit. To open the switch contact (and remove the capacitor from the light source circuit), the same solenoid is pulsed again. The solenoid thrust pin pushes the latching mechanism driver 253 back into abutment with the spinner 252, causing additional rotation of the spinner 252, which releases it from latched position or state and allows it to return (by gravity or some biasing member or method) to its original non-extended position. It is ready to re-latch upon the next pulsing of the solenoid.

Figure 9B:
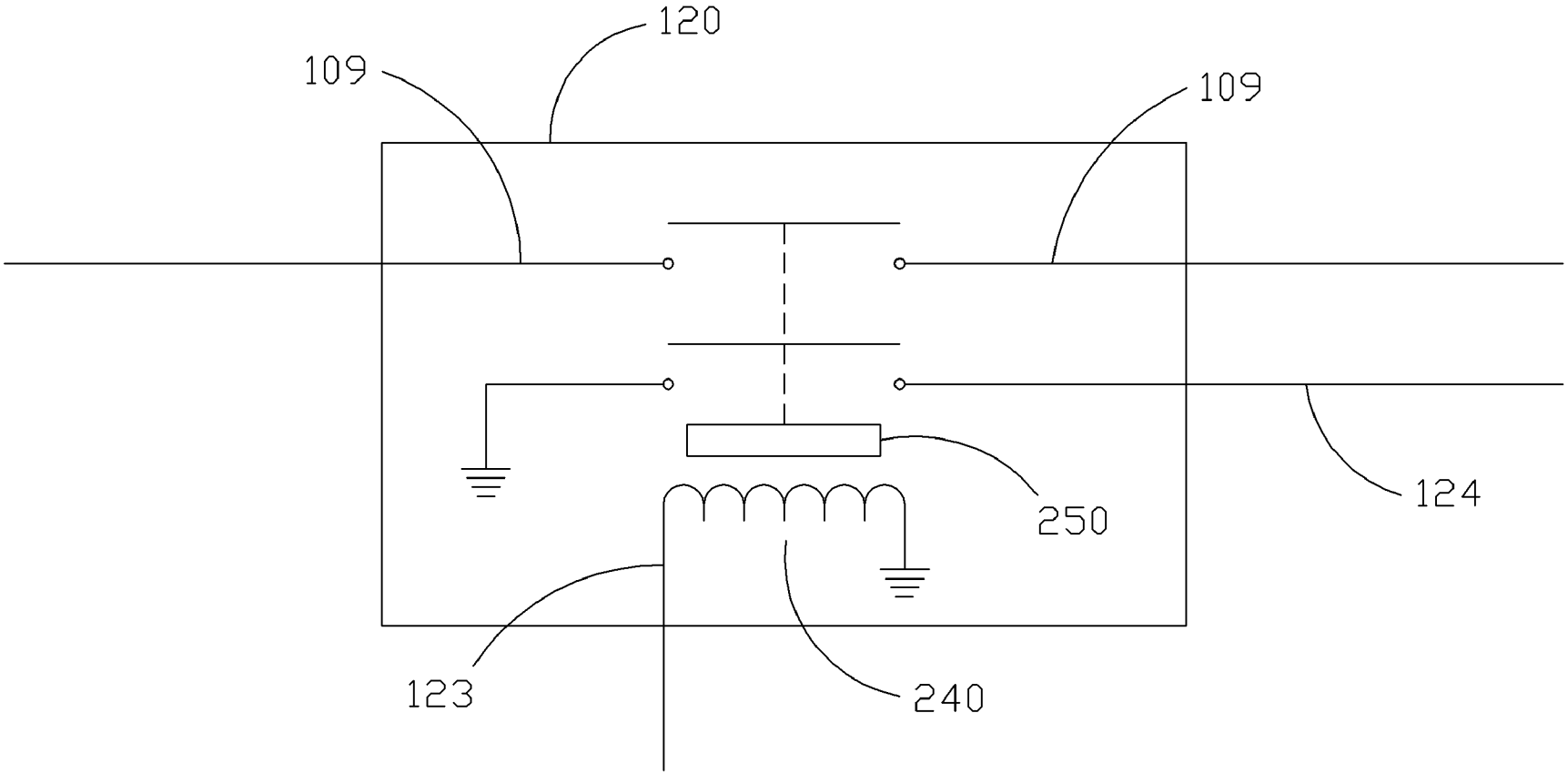
FIG. 9B illustrates a detailed view of the solenoid switching system illustrated in FIG. 9A.

Details of the switching mechanism 120 in FIG. 9A may be seen in FIG. 9B. As may be seen from FIG. 9B, pulsing of the solenoid 240 and associated latching mechanism 250 engages, in this example, a double pole-single throw (DPST) switch, the functionality of which connects wires 109 to complete the current path to the associated capacitor; additionally, when engaged, the DPST switch completes the current path illustrated in FIG. 9B for a switch feedback 124, effectively creating a short that is detected by a switch feedback circuit 122, FIG. 11A. With respect to FIG. 11A, operation of the light source 61, FIG. 11B, may be enabled by the following.

1. Upon installation of the electrical system (see FIG. 11B) the controller 56 (any of a variety of commercially available programmable digital controllers) is loaded with an operating profile via the communication connection (e.g. a typical interface for communication with a programmable digital or PC-based device with a digital controller).
   a. An operating profile utilizes known depreciation data for the light source 61, FIG. 11B, and adjusts power to the system, to maintain constant or near-constant light output or otherwise, via solenoid actuation signal 123 using the combinational approach illustrated in Table 2 at predetermined times, as indicated by the timer 44 (e.g. software or hardware) and facilitated by the solenoid actuation circuits 121.
   b. An operating profile may be changed or the timer 44 reset at any time via remote control 45 (or via other methods). An example of remote control may be found in U.S. Pat. No. 6,681,110, incorporated by reference herein, and commercially available under the trade name CONTROL-LINK® from Musco Lighting, LLC, Oskaloosa, Iowa, USA. As may be appreciated by one skilled in the art, the currently commercially available CONTROL-LINK® product may differ from that described in U.S. Pat. No. 6,681,110 as the mode of communication between an onsite component and a central server discussed in said patent (e.g. analog cellular signal) may comprise alternate modes of communication (e.g. satellite, Global System for Mobile communications (GSM), Code Division Multiple Access (CDMA), etc.).
   c. Switch status 124 received by the switch feedback circuits 122 ensures the correct capacitors, and therefore capacitance, are switched into the electrical system.
2. While operational, the light source 61, FIG. 11B, may be dimmed or brightened via remote control 45 or manually by the user control 32 (see, for example, U.S. Pat. No. 4,994,718).
   a. In one example, when the light source 61, FIG. 11B, is dimmed the operating profile is halted but the timer 44 continues to track usage. When the dimming function is disengaged the controller 56 restores the operating profile to the point at which it was halted. However, if the timer 44 indicates significant time has passed in the dimmed state, the operating profile is advanced to the next power level. For example, an operating profile comprises adding capacitance every 200 hours in the increments illustrated in Table 2 to the electrical system illustrated in FIG. 11B operating a light source 61 (e.g. a metal halide HID lamp with the characteristics of 1500 watt ROW, having LLD characteristics, and having a desired light output). At 195 hours, while the light source 61 is operating at 28 μf, a user dims the light source for 7 hours and then switches back to the higher illumination level using the user control 32, FIG. 11A. At this point 202 hours have passed, and normally, the controller 56 would re-establish 28 μf as the system capacitance for the higher illumination level. However, input from the timer 44 indicates the 200 hour threshold level has been passed and, thus, the controller 56 establishes 28.5 μf as the system capacitance for the higher illumination level. As will be appreciated by those of skill in the art, other regimes are programmable or configurable depending on need or desire. This illustrates aspects of flexibility of the system. By simple and changeable programming, different power level regimes may be instructed. A relatively few independently selectable capacitors enable a much larger number of power level possibilities. Any of these possibilities is available at any time, in any order.

In one embodiment, external feedback 57 to the circuit control 58 is provided via photocell or other light sensing device. U.S. patent application Ser. No. 11/963,084, incorporated by reference herein, discusses methods of compensating for degradation of the quantity of light output, due to LLD or otherwise, in a light source by sensing illumination levels and comparing against the pre-programmed operating profile. If sensed illumination level from the photocell differs from the anticipated illumination level based on the pre-programmed profile derived from known depreciation curves by a certain amount (e.g. 5%), the circuit control 58 will send an actuation signal 123 to the solenoids 240, FIG. 10A, to increase or decrease the system capacitance as necessary.

FIG. 11B illustrates one possible physical layout of the circuit control illustrated in FIG. 11A in an electrical system. Main electrical power for the circuit control 58 is diagrammatically indicated at block 55. As may been seen, the circuit control 58 is housed at the pole cabinet 50; this location is many times beneficial as it allows the circuit control 58 to exist in close proximity to the capacitor bank 53, thus limiting the length of wire (and associated cost) necessary to connect the circuit control 58, switching mechanism(s) 120, FIG. 9A, and capacitors. The timer 44 is housed in the control/contactor cabinet 40; this location is many times beneficial as it enables remote control functions 45 through an existing antenna 43 and moderator module 42. Remote control functions 45 are enabled by a central server (such as that discussed in the aforementioned U.S. Pat. No. 6,681,110 and aforementioned commercially available product under the trade name CONTROL-LINK® from Musco Lighting, LLC, Oskaloosa, Iowa, USA), communicated wirelessly (e.g. radio, satellite, etc.) to the antenna 43 and moderator module 42. Remote control 45, external feedback 57, and user control 32 functionalities are communicated from the moderator module 42 to the circuit control 58 via power line carrier technology; power line carrier technology is well known in the art and methods of applying said technology to lighting systems may be found in the aforementioned U.S. patent application Ser. No. 11/963,084. The inherent flexibility of the power line carrier technology is such that the physical location of the external feedback 57 and user control 32 may vary to suit a particular application or site.

It is of note FIG. 11B illustrates a complete circuit for one light source 61 only. However, one skilled in the art would know that multiple light sources 61 may be powered by a single pole cabinet 50. Further, breakers B-D (Ref. No. 31) may power contactor modules B-D (Ref. No. 41), which in turn each may power a corresponding pole cabinet B-D (not illustrated). The functionality of the circuit control illustrated in FIG. 11A may likewise be applied to the light source circuits housed at pole cabinets B-D (not illustrated).

D. Exemplary Method and Apparatus Embodiment 2

Figure 12A:
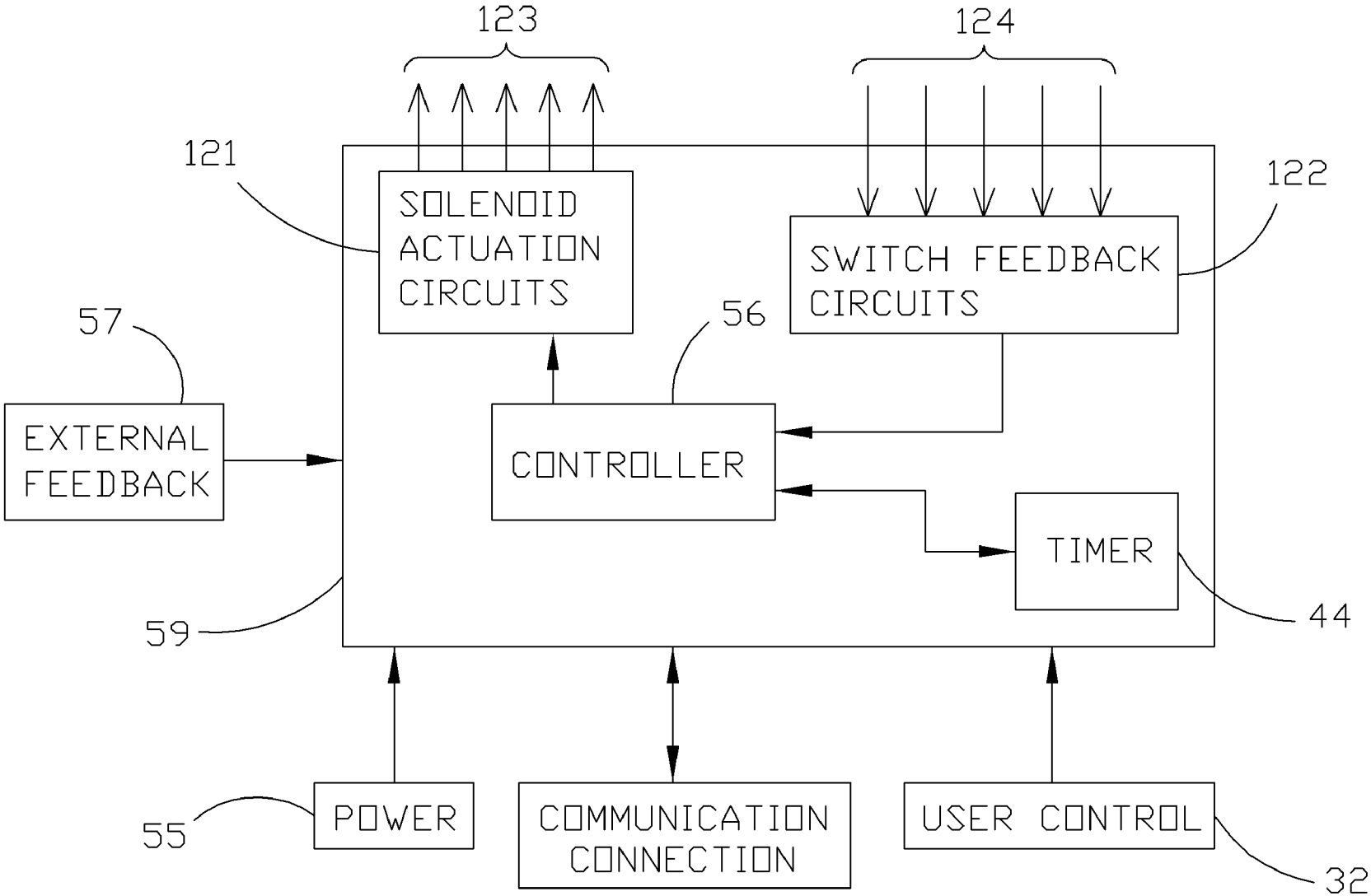
FIG. 12A illustrates an alternative exemplary embodiment in which the circuit control illustrated in FIG. 11A is modified for standalone operation.
Figure 12B:
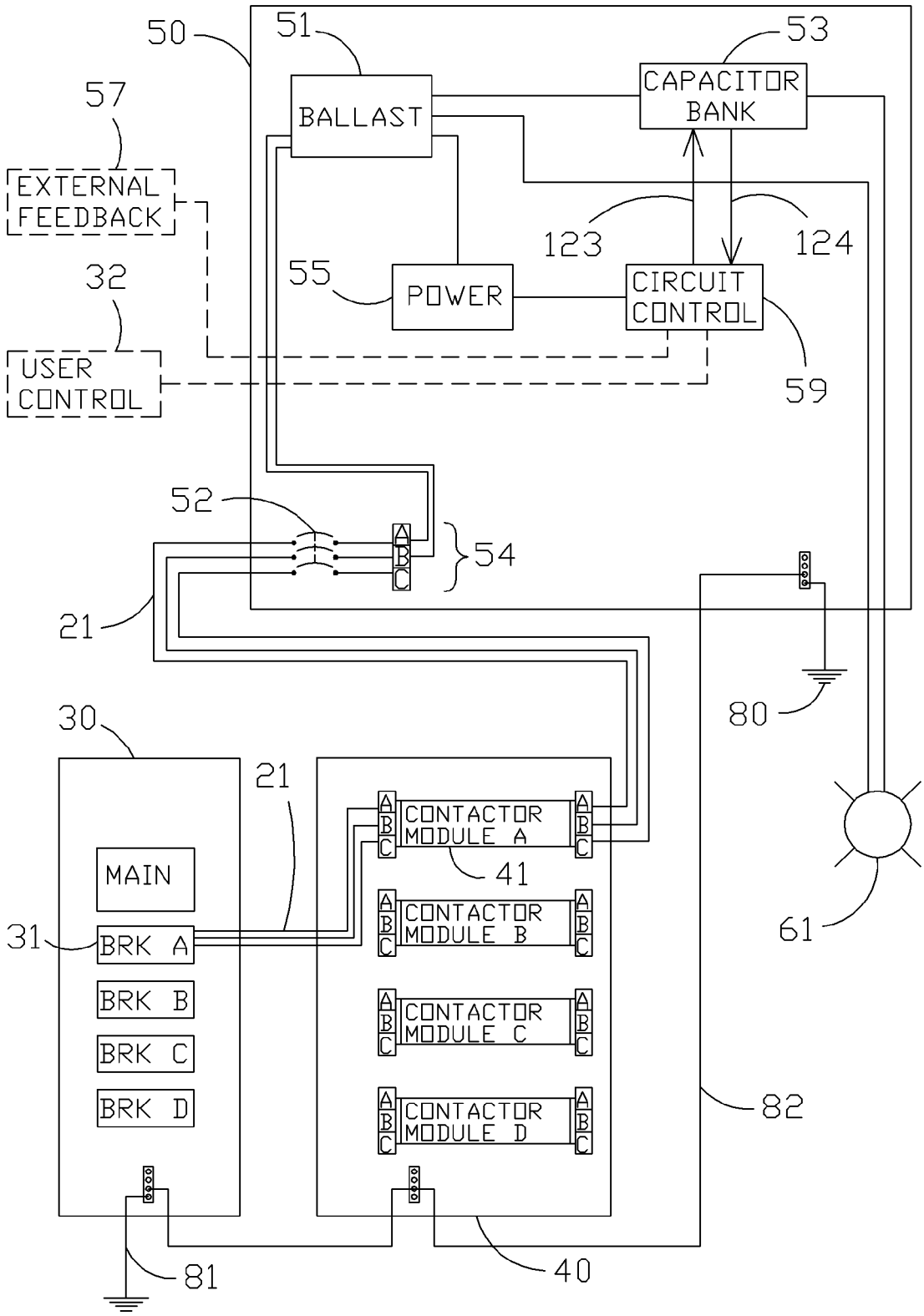
FIG. 12B illustrates an alternative exemplary embodiment in which the circuit control in FIG. 12A is installed in the electrical system illustrated in FIG. 4A.

An alternative embodiment of the invention envisions an electrical system operating a capacitor bank utilizing a plurality of capacitors as illustrated in FIG. 9A, to achieve the capacitance values illustrated in Table 2, enabled with a solenoid switching method as illustrated in FIGS. 9B and 10A-C; and operated by a circuit control is illustrated in FIGS. 12A and 12B. In this alternative embodiment the electrical system utilizing the improved switching methods and combinational capacitance as described herein does not have remote control capabilities. With respect to FIG. 12A, operation of the light source 61, FIG. 12B, may be enabled by the following.

1. Upon installation of the electrical system (see FIG. 12B), the controller 56 is loaded with multiple operating profiles via the communication connection.
   a. For example, an operating profile utilizes known depreciation data for the light source 61, FIG. 12B, and adjusts power to the system via solenoid actuation signal 123 using the combinational approach illustrated in Table 2 at predetermined times, as indicated by the timer 44 and facilitated by the solenoid actuation circuits 121.
   b. Switch status 124 received by the switch feedback circuits 122 ensures the correct capacitors, and therefore capacitance, are switched into the electrical system. If the switch feedback circuits 122 indicates a failure to initialize a particular operating profile, the controller 56 will attempt to initialize the operating profile more times (e.g. two more) before switching to a different operating profile.
   c. External feedback 57 to the circuit control 59 and the resultant changes to the operating profile is as in Exemplary Method and Apparatus Embodiment 1.
2. While operational, the light source 61, FIG. 12B, may be dimmed manually by the user control 32.
   a. When the light source 61, FIG. 4A, is dimmed the operating profile is halted but the timer 44 continues to track usage. When the dimming function is disengaged the controller 56 restores the operating profile to the point at which it was halted. However, if the timer 44 indicates significant time has passed in the dimmed state, the operating profile is advanced to the next power level as in Exemplary Method and Apparatus Embodiment 1.

FIG. 12B illustrates one possible physical layout of the circuit control illustrated in FIG. 12A in an electrical system. As may been seen, the circuit control 59 is housed at the pole cabinet 50; this location may be advantageous as it allows the circuit control 59 to exist in close proximity to the capacitor bank 53, thus limiting the length of wire (and associated cost) necessary to connect the circuit control 59, switching mechanism(s) 120, FIG. 9A, and capacitors. External feedback 57 and user control 32 functionalities are communicated directly to the circuit control 59; the timer 44 is contained within the circuit control 59.

It is of note that, as in FIG. 11B, FIG. 12B illustrates a complete circuit for one light source 61. However, as has been stated, one skilled in the art would know that multiple light sources 61 may be powered by a single pole cabinet 50, breakers B-D may power contactor modules B-D, which in turn may power pole cabinets B-D (not illustrated); and the functionality of the circuit control illustrated in FIG. 12A may likewise be applied to the light source circuits housed at pole cabinets B-D (not illustrated).

E. Exemplary Method and Apparatus Embodiment 3

Figure 13A:
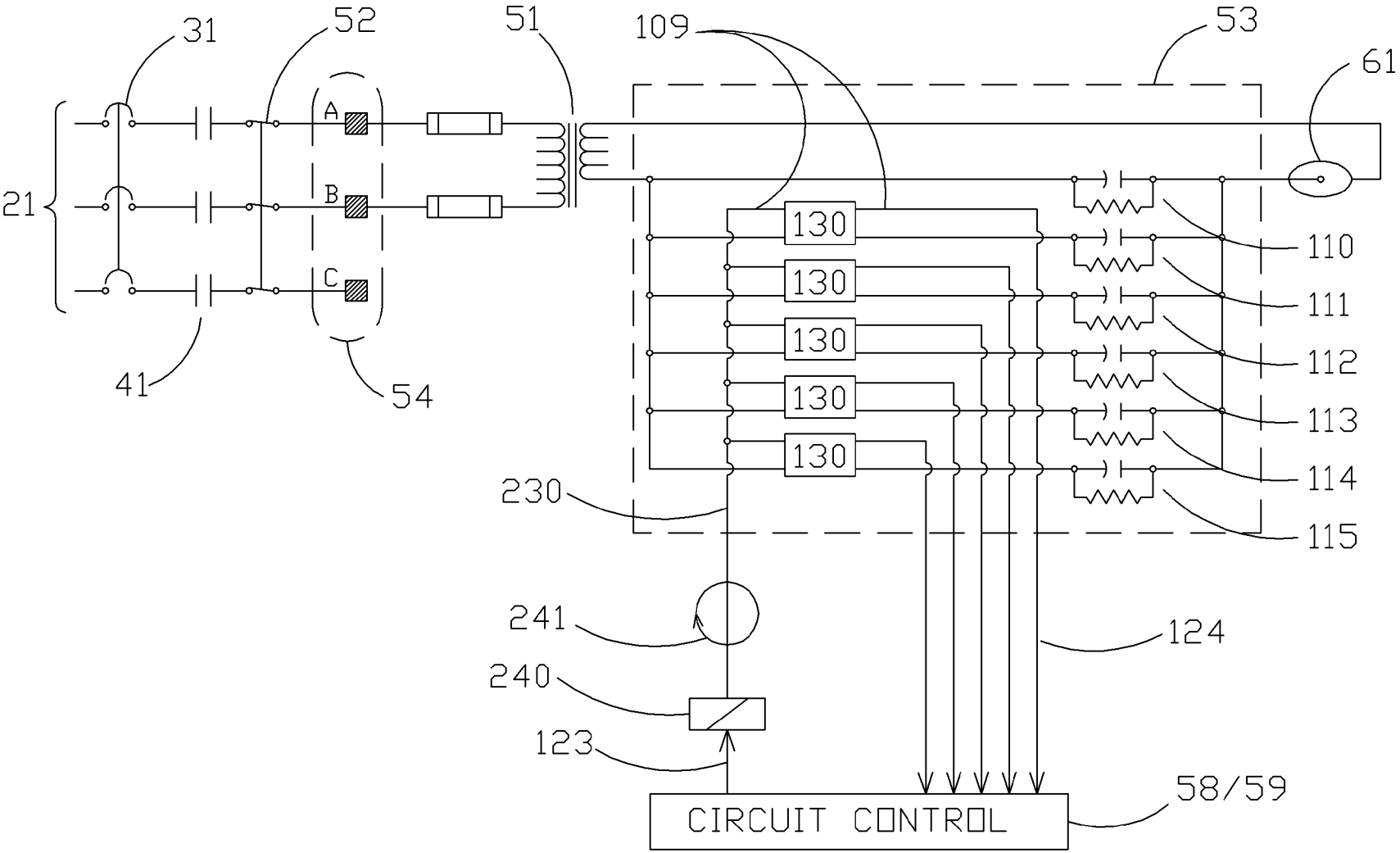
FIG. 13A illustrates an exemplary embodiment in which a light source circuit is enabled with a cam/solenoid switching system and circuit control.
Figure 13B:
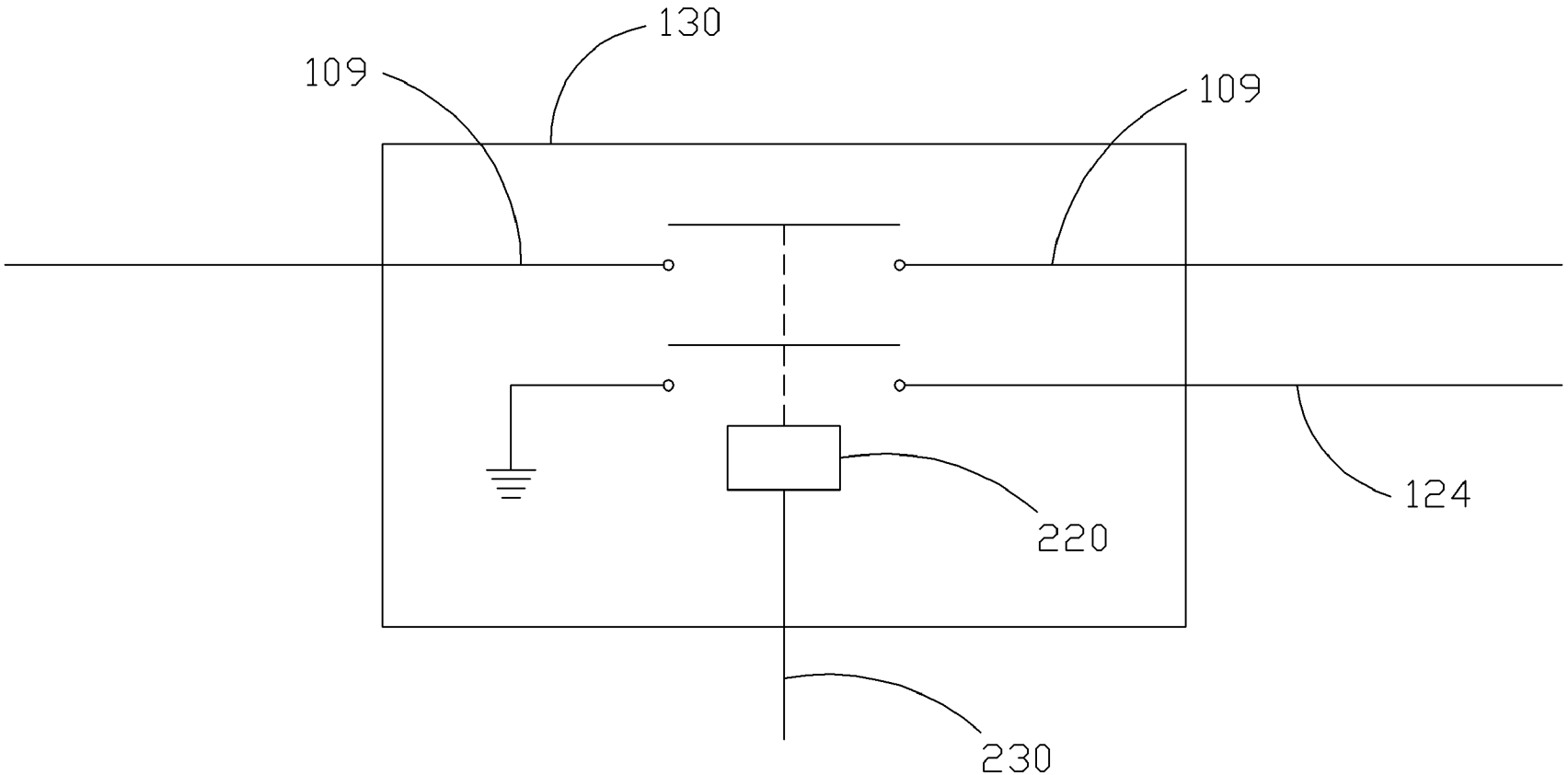
FIG. 13B illustrates a detailed view of the cam/solenoid switching system illustrated in FIG. 13A.
Figure 14A:
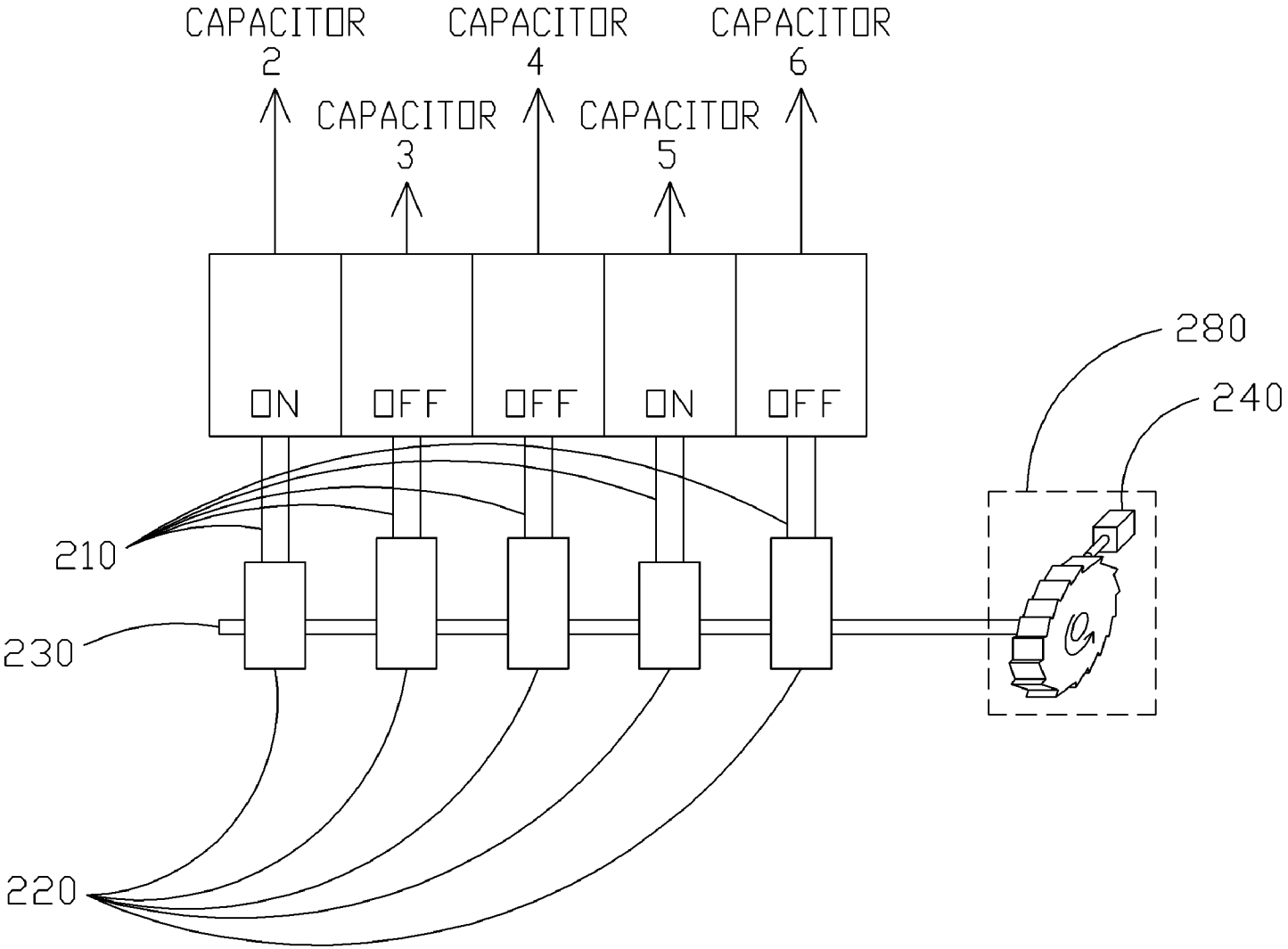
FIG. 14A illustrates an exemplary embodiment in which capacitance changes are enabled by the cam/solenoid switching system illustrated in FIGS. 13A and 13B.
Figure 14B:
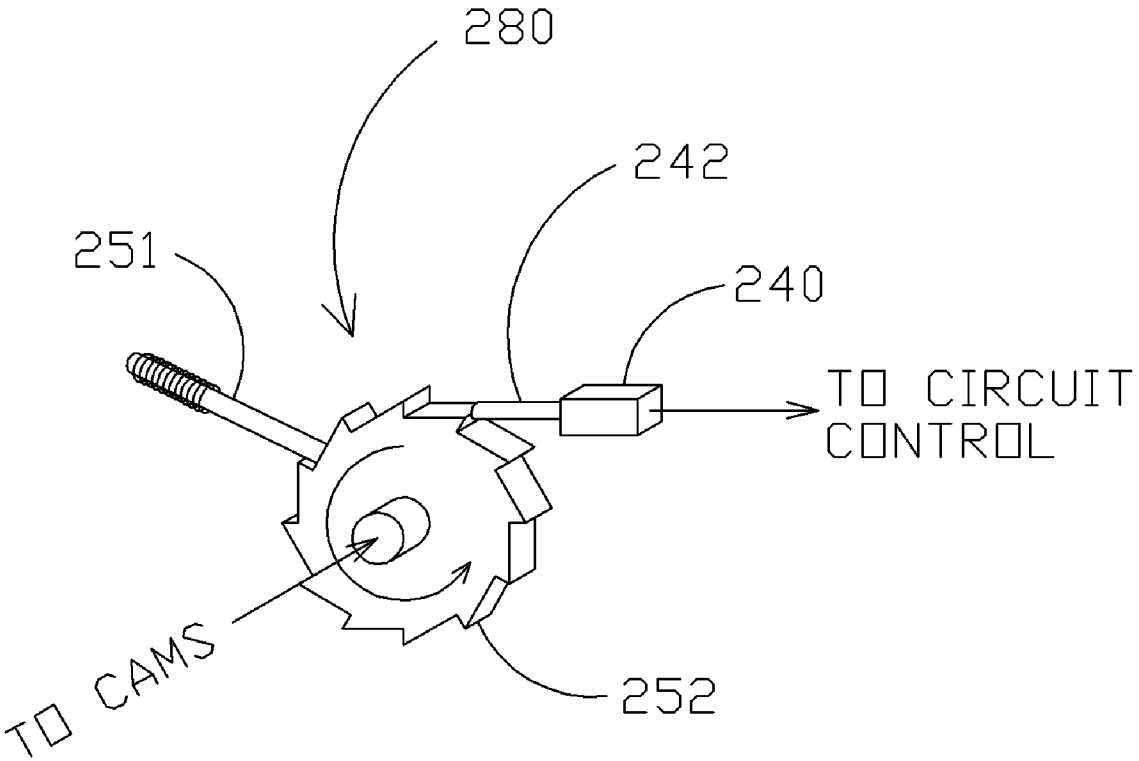
FIG. 14B illustrates an exemplary embodiment in which the mechanical escapement illustrated in FIG. 14A is detailed.

An alternative embodiment of the invention envisions an electrical system operating a capacitor bank utilizing a plurality of capacitors as illustrated in FIG. 13A enabled with a cam/solenoid switching method as illustrated in FIGS. 13B, 14A and 14B; and operated by a circuit control as illustrated in FIG. 11A/11B or 12A/12B. In this alternative embodiment the motor in the cam/motor system used in current art is replaced with a solenoid.

As may be seen from FIG. 13A, the circuit control 58/59 operates a pulsed solenoid 240 via solenoid actuation signal 123; the circuit control 58/59, solenoid 240, and actuation signal 123 are as in Exemplary Method and Apparatus Embodiments 1 and 2. The solenoid actuates a mechanical escapement 280, FIG. 14A, which, in turn, operates the armature 230, FIG. 14A and associated cams 220, FIG. 14A, to provide the rotary switching function 241 to each switching mechanism 130; as may be seen from FIG. 13B, functionality of the switching mechanism 130 (e.g. a DPST switch that connects wires 109 to complete the current path to the associated capacitor and completes the current path for the switch feedback 124) is as in Exemplary Method and Apparatus Embodiments 1 and 2.

As may be seen from FIG. 14A, the interaction between the armature 230, cams 220, and pushrods 210 is as described for FIG. 6. However, rotation of the armature 230 is enabled by engagement of the mechanical escapement 280 by the solenoid 240. FIG. 14B illustrates a detailed view of the escapement 280 in which pulsing of the solenoid 240 actuates a thrust pin 242 which, in turn, contacts a gear cog 252 and causes rotation (shown to be in the counter-clockwise direction); a spring loaded lever 251 prevents rotation in the clockwise direction.

While this alternative embodiment is limited to preset combinations of capacitance changes due to the physical tolerances of the cams 220, there may be benefits over existing cam/motor systems. For example, existing cam/motor systems require a motor with significant gear reduction to accommodate the continuous rotation of the cams 220, requiring significant space in the electrical enclosure housing the switching mechanism(s). The present embodiment only rotates the cams 220 when the solenoid 240 receives an actuation signal 123, FIG. 13A, from the circuit control 58/59, which eliminates the need for a large motor assembly. As previously stated and is illustrated in FIG. 6, cam/motor systems rotate in a single direction with cams 220 designed to engage each switch only once until the unit is reset and the process starts over (i.e. capacitance is added sequentially). Further, the speed and accuracy of the capacitance changes are limited by the physical tolerances of the cams 220 and motor assembly. In the present embodiment switch timing and accuracy is improved through use of the solenoid. Further, the cams 220 may now be profiled to engage the pushrods 210 multiple times and the escapement 280 may be designed with any number of cogs 252, adding versatility to the system.

F. Exemplary Method and Apparatus Embodiment 4

Figure 15:
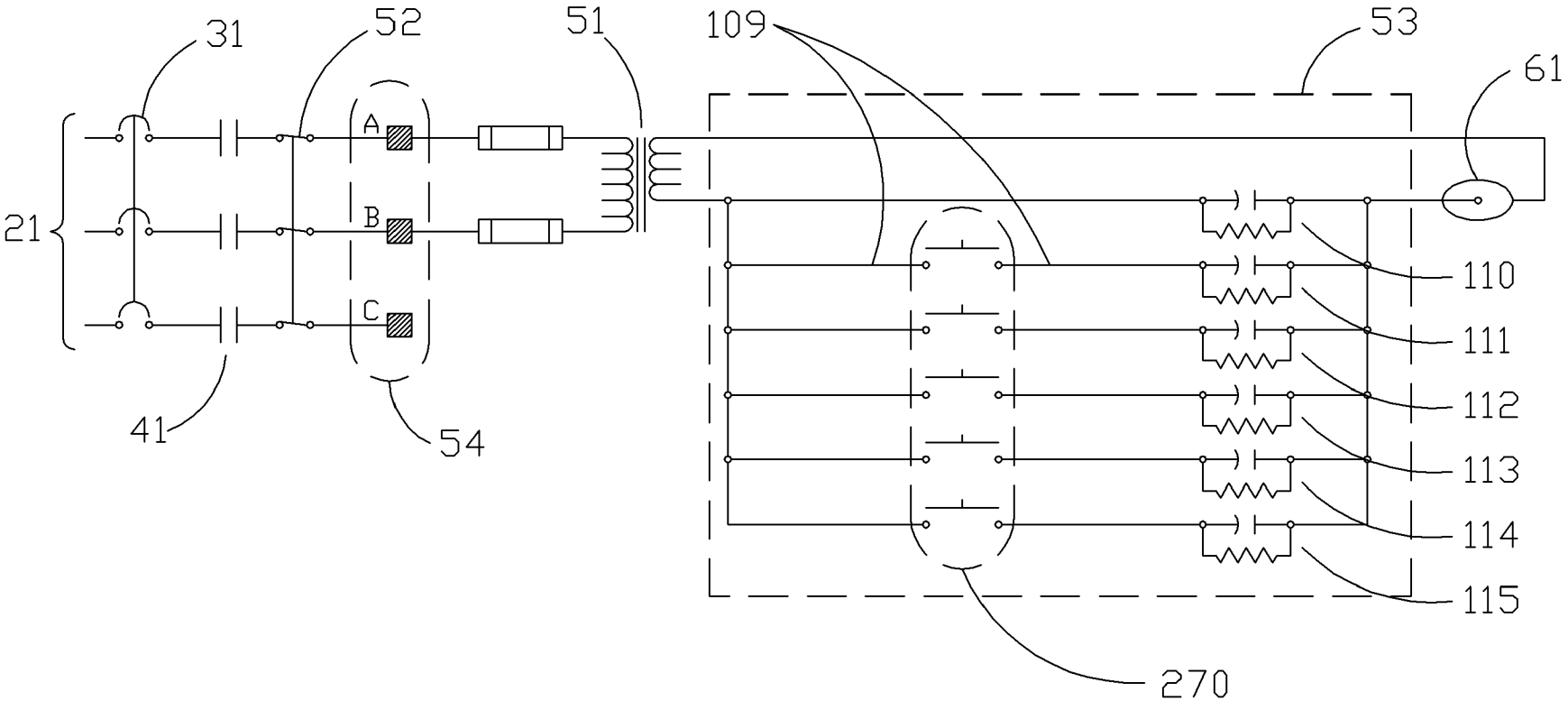
FIG. 15 illustrates an exemplary embodiment in which a light source circuit is enabled with a selector switching system.
Figure 16:
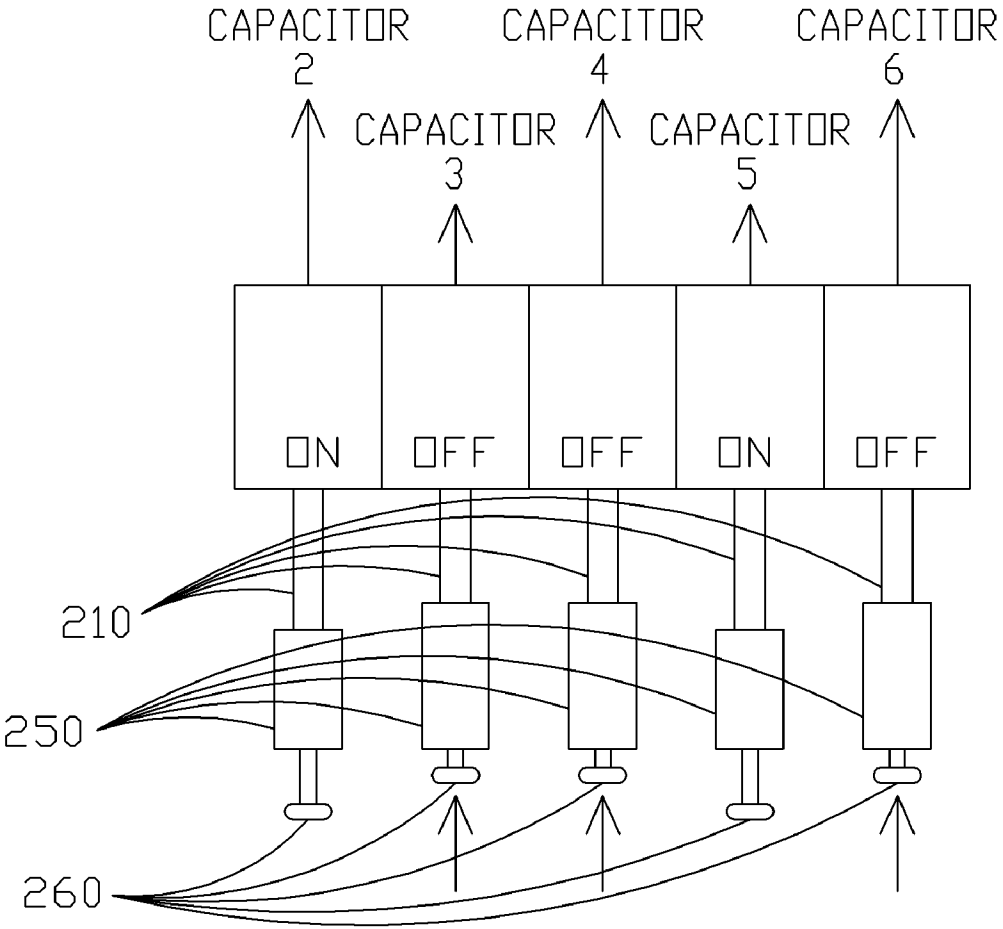
FIG. 16 illustrates an exemplary embodiment in which capacitance changes are enabled by the selector switching system illustrated in FIG. 15.

An alternative embodiment of the invention envisions an electrical system operating a capacitor bank utilizing a plurality of capacitors as illustrated in FIG. 15 enabled with a selector switching method as illustrated in FIG. 16. In this alternative embodiment the cam/motor system used in current art is replaced with a manually operated selector switch.

As may be seen from FIG. 15, there is no circuit control for the selector switching method 270 as the method is manually operated. As may be seen from FIG. 16, the interaction between the pushrods 210 and the latching mechanism 250 is generally as is illustrated in FIGS. 10B and 10C; however, a manually depressible pushbutton 260 is used to engage the latching mechanism 250. When a capacitor is off (i.e. its capacitance is not added to the circuit) the relevant pushbutton 260 or pushbuttons 260 is/are depressed, as may be seen for Capacitors 3, 4, and 6. When a capacitor is on (i.e. its capacitance is added to the circuit) the pushbutton is released (unlatched), as may be seen for Capacitors 2 and 5. Latching may be by a variety of methods and means, including that indicated by latching mechanism 250, described previously, or other examples described herein. An example of a manually operably latching pushbutton device is model LC2254EENP-ND from Digi-Key of Thief River Falls, Minn., U.S.A.

While this alternative embodiment does not benefit from the improved solenoid switching methods as in Exemplary Method and Apparatus Embodiments 1 and 2, there may be benefits over existing cam/motor systems. For example, each capacitor may be switched in or out of the light source circuit in any combination at any time, giving the system significant flexibility.

G. Exemplary Method and Apparatus Embodiment 5

Figure 17:
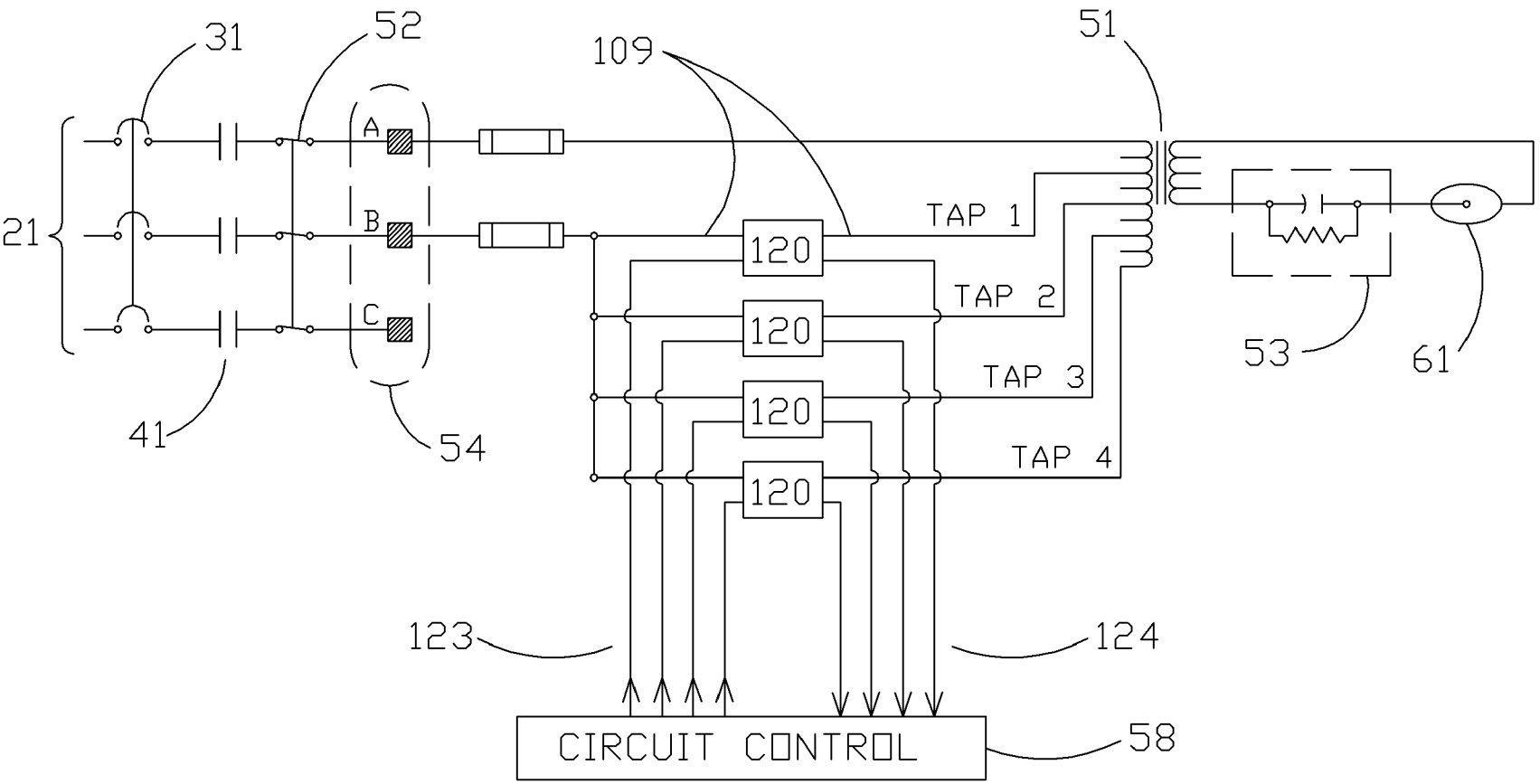
FIG. 17 illustrates an exemplary embodiment in which the ballast in a light source circuit is enabled with a solenoid switching system and circuit control.
Figure 18:
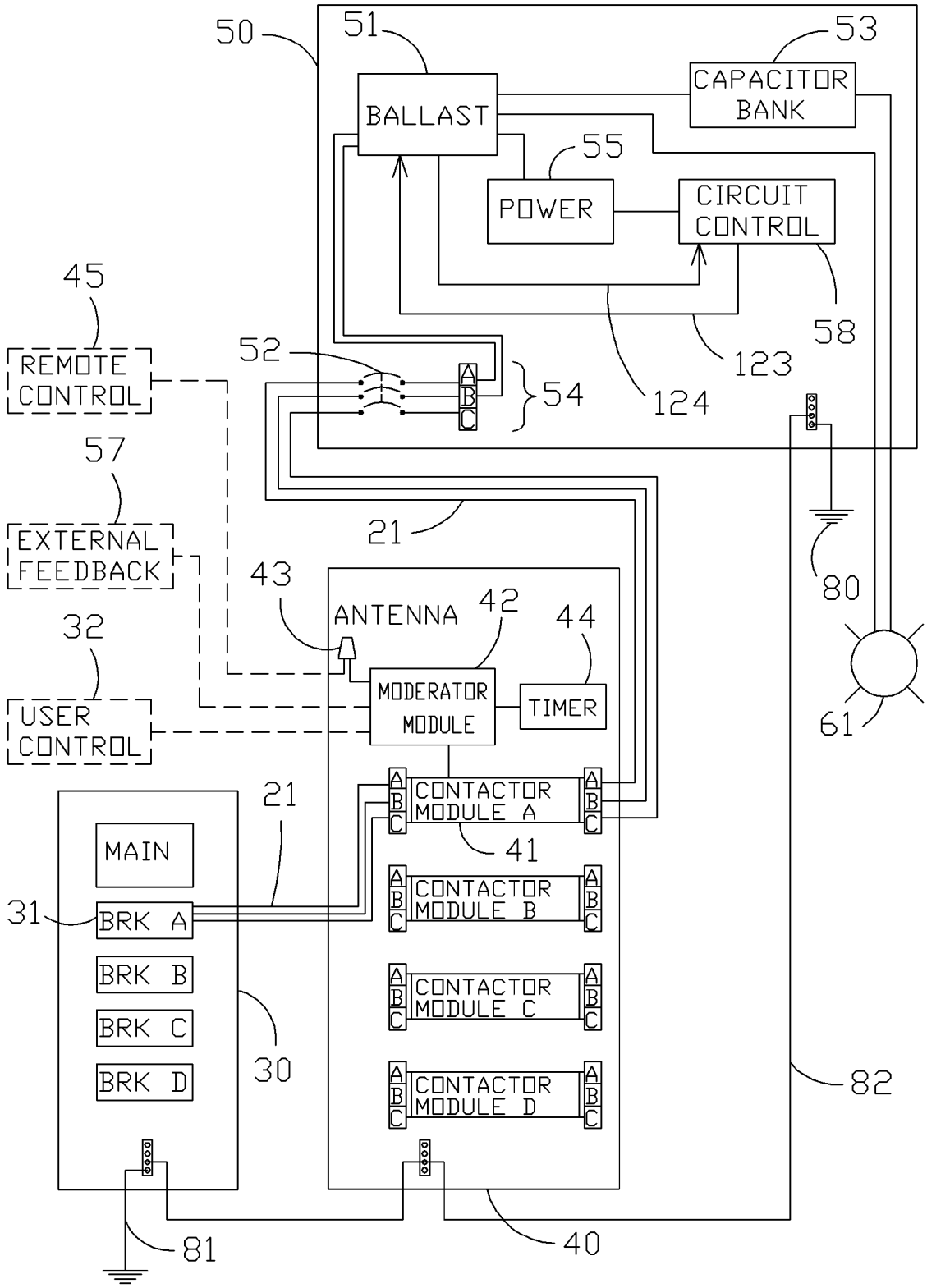
FIG. 18 illustrates an exemplary embodiment in which the circuit control in FIG. 11A is modified for the light source circuit illustrated in FIG. 17 and is installed in the electrical system illustrated in FIG. 4A.

An alternative embodiment of the invention envisions an electrical system operating a ballast from which multiple taps are accessed to vary the incoming power to a capacitor bank (in this example, the capacitor bank utilizing a single capacitor as illustrated in FIG. 17, though other embodiments may utilize multiple capacitors in the capacitor bank) and operated by a circuit control as illustrated in FIGS. 11A and 18. In this alternative embodiment the ballast tap switching methods used in current art (particularly those referenced in the aforementioned U.S. Pat. No. 7,176,635) are replaced with the improved solenoid switching methods described herein.

With regards to U.S. Pat. No. 7,176,635, power to the light source is adjusted by switching between taps on the primary side of a lead-peak ballast; technical detail regarding the ballast design may be found in FIG. 7 and Table 2 in U.S. Pat. No. 7,176,635. The primary limitation of adjusting power by such methods is the complex switching mechanisms that ensure switching overlaps to prevent interruptions to power distribution. Modification of the light source circuit illustrated in FIG. 7 in U.S. Pat. No. 7,176,635 to utilize the improved switching methods described herein produces the light source circuit illustrated in FIG. 17. As may be seen from FIG. 17, the functionality of the ballast 51 has not changed from that illustrated in FIG. 7 of U.S. Pat. No. 7,176,635; however, the circuit now comprises solenoid switching 120 as in Exemplary Embodiment and Apparatus Embodiments 1 and 2 (applied to a plurality of ballast taps rather than a plurality of capacitors). Circuit control, as illustrated in FIG. 11A, is generally enabled as in Exemplary Embodiment and Apparatus Embodiment 1; however, the circuit control 58 utilizes an operating profile, external feedback 57, remote control 45, and user control 32 to switch taps on the ballast 51, FIG. 17, rather than capacitors in the capacitor bank 53, FIG. 17. It is of note that, as an alternative to circuit control 58, circuit control as illustrated in FIG. 12A (Ref. No. 59) may be utilized; operating profile(s), external feedback 57, and user control 32 would generally be enabled as in Exemplary Embodiment and Apparatus 2 with appropriate changes made to switch taps on the ballast 51, FIG. 17, rather than capacitors in the capacitor bank 53.

In the present embodiment switch timing and accuracy may be improved through use of the solenoid switching 120, as the switching method illustrated in FIG. 7 of U.S. Pat. No. 7,176,635 utilizes a traditional cam and motor assembly. Use of solenoid switching 120 may eliminate the need for switches to overlap to ensure continuity of power distribution. Additionally, switching between taps on the ballast 51 conserves space in the pole cabinet 50 and reduces cost compared to systems utilizing a plurality of capacitors to adjust power.

Also, because power levels can be adjusted by changing taps on the primary side, secondary side, or both sides of the ballast that is in the lamp circuit, the capacitor bank 53, in this embodiment, need only have a base capacitor of the capacitance value indicated for the lamp. Note though that optionally, there could be a capacitor bank of plural capacitors individually and independently switchable into parallel with the lamp (such as in previous embodiments) that could be used in combination with the ballast tap switching described with this embodiment to give even more power options for the lamp.

H. Options and Alternatives

As mentioned previously, the invention may take many forms and embodiments. The foregoing examples are but a few of those. To give some sense of some options and alternatives, a few examples are given below.

Generally, the exemplary embodiments described herein illustrate a complete electrical circuit for a single light source (see FIG. 4A). It is of note, however, that this is by way of example and not by way of limitation. For example, those skilled in the art would know that the moderator module 42 may regulate all of the contactor modules within the control/contactor cabinet 40, and/or a pole cabinet 50 and the components therein may power a plurality of light sources 61. As a further example, the capacitor bank 53 may comprise any quantity of capacitors with any associated capacitance (provided enough physical space was available (e.g. in the pole cabinet 50)). The methods of improved switching and adjusting power through combinational capacitance described herein may be applied to electrical systems other than that illustrated in FIG. 4A, or applied to variations of the components therein, without departing from at least some aspects of the invention.

Methods of improved switching and adjusting power through combinational capacitance as exemplified by the embodiments described herein may be combined to produce a composite electrical system without departing from at least some aspects of the invention. For example, published U.S. Patent Application US2008/0150451 A1, issued as U.S. Pat. No. 7,982,404 on Jul. 19, 2011 and incorporated by reference herein, discusses methods of switching capacitors in and out of a capacitor bank together with switching between taps on a ballast to adjust power to a light source. Such a system would benefit from both Exemplary Method and Apparatus Embodiments 1 and 2 (thus providing improved switching methods to the capacitor bank) and Exemplary Method and Apparatus Embodiment 5 (thus providing improved switching methods to the ballast).

As stated in Exemplary Method and Apparatus Embodiments 1-3 and Exemplary Method and Apparatus Embodiment 5, external feedback 57 may be provided via photocell. It is of note that any external device capable of comparing illumination levels at different times (whether actual or perceived) at a source (whether a target area or the light source) may be utilized and not depart from aspects of the invention. It is also of note that the feedback 57 may be used by a plurality of circuit controls (e.g. whether a plurality of circuit controls within a single electrical enclosure (e.g. pole cabinet 50) or a combination of circuit controls within a plurality of electrical enclosures) to adjust power to their respective light source(s). Alternatively, several photocells (or other illumination sensing devices) may be utilized to produce a composite feedback 57 to a circuit control (or plurality of circuit controls). Other external feedback is possible. Examples include but are not limited to sensed light levels (whether at the lamp or a target area) from devices other than photocells (e.g. photodiodes), sensed light levels from other sources of illumination (e.g. other light sources at the same site location), temperature, humidity, wind conditions (e.g. speed, direction, etc.), or other feedback deemed useful to the application.

As stated in Exemplary Method and Apparatus Embodiments 1-3 and Exemplary Method and Apparatus Embodiment 5, methods or means to adjust power to a light source were enabled by a pulsed solenoid operated by a circuit control. It is of note that a variety of solenoid types (e.g. pulsed, latching, etc.) under a variety of operating conditions (e.g. AC driven, continuous duty, etc.) for a given type of light source may be utilized and not depart from aspects of the invention.

As stated in Exemplary Method and Apparatus Embodiments 1, 3, and 5, methods or means of remotely controlling the circuit control 58 was enabled by a central server (i.e. CONTROL-LINK®) communicating wirelessly to the antenna 43 and moderator module 42. It is of note that any of a variety of methods or means of communicating between a central server and the moderator module 42 (whether wireless or otherwise) may be utilized and not depart from at least some aspects of the invention. It is also of note that means of communicating remote control 45, external feedback 57, and user control 32 functionalities from the moderator module 42 to the circuit control 58 are not limited to the power line carrier technology described herein. Any of a variety of methods or means of communicating between the moderator module 42 (or analogous component) and the circuit control 58 may be utilized and not depart from aspects of the invention. It is of further note that, similar to the feedback 57, the remote control 45 and user control 32 functionalities may be utilized by a plurality of circuit controls (e.g. whether a plurality of circuit controls within a single pole cabinet 50 or a combination of circuit controls within a plurality of pole cabinets 50) to adjust power to their respective light source(s).

As stated in Exemplary Method and Apparatus Embodiments 2, 3, and 5, remote control functionality may be omitted and the circuit control 59 modified from circuit control 58 such that if the switch feedback circuits 122 indicate a failure to initialize a particular operating profile, the controller 56 may attempt to initialize the operating profile two more times before switching to a different operating profile. It is of note that any number of initialization attempts, as well as any number of operating profiles, may be utilized and not depart from aspects of the invention.

As stated in Exemplary Method and Apparatus Embodiment 3, methods or means to adjust power to a light source was enabled by a mechanical escapement 280, FIG. 14A. It is of note that a variety of escapements types (e.g. mechanical, electromechanical, liquid, etc.) and designs (e.g. simple, verge, anchor, etc.) may be utilized and not depart from aspects of the invention.

As stated in Exemplary Method and Apparatus Embodiment 4, methods or means to adjust power to a light source was enabled by a selector switch 270, FIG. 15, operated manually. It is of note that a variety of manually operated switches (e.g. pushbutton, toggle, rocker, etc.) may be utilized and not depart from aspects of the invention. Additionally, the selector switch 270, FIG. 15, may be enabled with a user-perceivable feature (e.g. an LED in the switch interface) such that the switch interface (i.e. the pushbutton 260, FIG. 16) may clearly indicate to a user (e.g. the pushbutton 260 will illuminate) when an associated capacitor is on (i.e. its capacitance is added to the circuit).

As stated in Exemplary Method and Apparatus Embodiment 5, means to adjust power to a light source was enabled by switching between multiple taps on the primary side of a lead-peak ballast. It is of note that the improved solenoid switching method 120, FIG. 17, and associated circuit control FIGS. 11A/12A and 18 may be applied to a variety of ballast types (e.g. lead-peak, linear reactor, high-reactance autopower, etc.) with taps on either the primary or secondary side, as is discussed in the aforementioned U.S. Pat. No. 7,982,404, for a given type of light source and not depart from at least some aspects of the invention.

What is claimed is:

1. A method of controlling operating power of a light source in a light source circuit including the light source and a connection to a source of electrical power comprising:

a. providing a first operatingp ower level to the light source from the source of electrical power in the light source circuit; and b. providing a different operating power level to the light source by selecting from a plurality of independently selectable operating power levels, wherein the step of selecting comprises actuating at least one of a plurality of independently actuatable switching mechanisms wherein the switching mechanisms each comprise a solenoid which controls a switch contact.

2. The method of claim 1 further comprising at least one additional independently actuatable switching mechanism wherein the at least one additional switching mechanism does not comprise a solenoid which controls a switch contact and wherein any combination of the one or more switching mechanisms and the at least one additional switching mechanism can be actuated to provide the different operating power levels, wherein the independently selectable operating power levels differ depending upon which of the switching mechanisms or the additional switching mechanisms are actuated.

3. The method of claim 1 applied to each of a plurality of light sources.

4. The method of claim 1 wherein the actuating is controlled by a programmable processor.

5. The method of claim 4 wherein the programmable processor is programmable with an operating profile or plurality of operating profiles comprising instructions to change power levels based on time and/or magnitude related to one or more of:

a. control or conserve amount of electrical energy consumed;
b. control light output of the light source;
c. maintain constant or near-constant light output; and
d. compensate for lamp lumen depreciation or other lumen depreciation or loss.

6. The method of claim 4 further comprising providing feedback to the processor, the feedback comprising one or more of:

a. an internal characteristic of operation such as switching mechanism status; and
b. an external characteristic related to operation such as:
   i. sensed light level associated with the light source;
   ii. sensed light level associated with ambient light source(s);
   iii. ambient temperature;
   iv. ambient humidity; or
   v. ambient wind conditions.

7. The method of claim 1 wherein the power levels are associated with varying levels of impedance in the light source circuit.

8. The method of claim 7 wherein the varying levels of impedance comprise a plurality of capacitors.

9. The method of claim 1 wherein the power levels are associated with varying voltage levels to the light source.

10. The method of claim 9 wherein the varying voltage levels are associated with different taps on primary, secondary, or both sides of a transformer or ballast.

11. The method of claim 1 wherein the power levels are associated with varying levels of impedance and/or voltage to the light source.

12. The method of claim 1 wherein the independently selectable power levels are selectable at any time and in any order.

13. An apparatus for adjustably controlling operating power of a light source comprising:

a. a light source circuit including the light source and a connection to a source of electrical power;
b. a power regulating circuit operatively connected in the light source circuit between the light source and the source of electrical power, the power regulating circuit comprising:
   i. a power regulating component capable of producing different operating power levels to the light source dependent upon different configurations of the power regulating component;
   ii. a plurality of switching mechanisms operatively connected to the power regulating component, each switching mechanism independently actuatable to produce at least some of the different configurations of the power regulating component; and
c. a circuit control in operative connection with the switching mechanisms, the circuit control comprising a programmable processor adapted to instruct operation of the switching mechanisms by:
   i. a pre-programmed operating profile;
   ii. remote control from another processor; or
   iii. manual control;
d. so that by selective actuation of different switching mechanisms, different operating power levels to the light source can be selected.

14. The apparatus of claim 13 wherein the power regulating component comprises a plurality of capacitors in parallel with the light source.

15. The apparatus of claim 14 wherein at least one capacitor is in series with a switching mechanism.

16. The apparatus of claim 15 wherein at least two capacitors are of different capacitive values.

17. The apparatus of claim 16 wherein one of the at least two capacitors is of much larger capacitive value than all other capacitors.

18. The apparatus of claim 13 wherein the operating profile comprises known lamp lumen depreciation data for the light source.

19. The apparatus of claim 13 wherein the operating profile is changeable at the circuit control or by remote control.

20. The apparatus of claim 13 wherein the circuit control further comprises a switching mechanism status feedback circuit for informing the processor of positional status of the switching mechanism.

21. The apparatus of claim 13 wherein the circuit control further comprises an external feedback component to inform the processor of a status or characteristic external of the apparatus.

22. The apparatus of claim 21 wherein the external feedback component comprises one or more of a sensor for measuring:

a. light level associated with the light source;
b. light level associated with ambient light sources;
c. ambient temperature;
d. ambient humidity; or
e. ambient wind conditions.

23. The apparatus of claim 13 wherein the circuit control is substantially electrically isolated from the switching mechanisms.

24. The apparatus of claim 13 wherein the circuit control further comprises a remote control interface adapted for operative connection to a remote control center.

25. The apparatus of claim 13 wherein the switching mechanism comprises:

a. a switch contact; and
b. an actuator to open or close the switch contact.

26. The apparatus of claim 25 wherein the actuator comprises a solenoid.

27. The apparatus of claim 26 wherein the solenoid includes a latching solenoid or is operatively connected to a latching mechanism.

28. The apparatus of claim 25 wherein the actuator comprises a solenoid and a cam.

29. The apparatus of claim 25 wherein the actuator comprises a manually operable member.

30. The apparatus of claim 13 wherein the power regulating component comprises a transformer between the light source and the source of electrical power and including plural taps on the primary, secondary, or both sides, different sets of the plural taps being selectable by actuation of different switching mechanisms.

31. The apparatus of claim 13 further comprising a second power regulating circuit between the light source and the source of electrical power, the second power regulating circuit comprising:

a. a second power regulating component capable of producing different operating power levels to the light source dependent upon different configurations of the second power regulating component; and b. a plurality of switching mechanisms operatively connected to the second power regulating component, each switching mechanism independently actuatable to produce at least some of the different configurations of the second power regulating component.

32. The apparatus of claim 31 wherein the power regulating component comprises a transformer between the light source and the source of electrical power and including plural taps on the primary, secondary, or both sides, different sets of the plural taps being selectable by actuation of different switching mechanisms, and the second power regulating component comprises a plurality of capacitors in parallel with the light source, each capacitor in series with a switching mechanism.

33. The apparatus of claim 13 wherein each light source comprises a high intensity light source.

34. The apparatus of claim 33 wherein each high intensity light source is mounted in a wide area lighting fixture.

35. The apparatus of claim 34 wherein each wide area lighting fixture is mounted on an elevating structure and each power regulating component is mounted in an electrical enclosure.

36. A system of operating one or more light sources comprising:

a. a light source;

b. a source of electrical power; and c. a power regulating component comprising:

i. a plurality of capacitors connected in parallel with the light source;

ii. a switching component operatively connected to at least one of the capacitors allowing selective switching in or out of each of the connected capacitors and wherein the switching component comprises one or more solenoids or one or more solenoids in combination with one or more cams;

iii. such that any combination of connected capacitors may be switched in or out of the light source circuit to achieve a desired power level, so that a relatively small group of capacitors provides a relatively large range of capacitance values for a single light source or a plurality of light sources from a single switch control.

37. The system of claim 36 further comprising an electronic control operatively connected to the switching components to control the switching components.

38. The system of claim 36 wherein the switching component further comprises a manually operable member.

* * * * *

UNITED STATES PATENT AND TRADEMARK OFFICE

CERTIFICATE OF CORRECTION

PATENT NO. : 8,247,990 B1
APPLICATION NO. : 12/534504
DATED : August 21, 2012
INVENTOR(S) : Myron Gordin et al.

It is certified that error appears in the above-identified patent and that said Letters Patent is hereby corrected as shown below:

Column 20, Claim 1, Line 60:
DELETE after first "operatingp ower"
ADD after first --operating power--

Signed and Sealed this
Sixth Day of November, 2012

David J. Kappos

David J. Kappos
*Director of the United States Patent and Trademark Office*